United States Patent [19]

Fujita et al.

[11] Patent Number: 4,853,318

[45] Date of Patent: Aug. 1, 1989

[54] PROCESS FOR PROCESSING SILVER HALIDE COLOR PHOTOGRAPHIC MATERIAL USING A DEVELOPER COMPRISING SUBSTANTIALLY NO BENZYL ALCOHOL

[75] Inventors: Yoshihiro Fujita; Hiroshi Fujimoto; Takatoshi Ishikawa; Shinzo Kishimoto, all of Kanagawa, Japan

[73] Assignee: Fuji Photo Film Co., Ltd., Kanagawa, Japan

[21] Appl. No.: 15,647

[22] Filed: Feb. 17, 1987

[30] Foreign Application Priority Data

Feb. 17, 1986 [JP] Japan ..... 61-32465
Jul. 29, 1986 [JP] Japan ..... 61-178443

[51] Int. Cl.[4] ..... G03C 7/30; G03C 5/24

[52] U.S. Cl. ..... 430/380; 430/372; 430/377; 430/464; 430/467; 430/469; 430/548

[58] Field of Search ..... 430/372, 377, 380, 464, 430/467, 469, 548

[56] References Cited

U.S. PATENT DOCUMENTS

| | | | |
|---|---|---|---|
| 3,746,544 | 7/1973 | Heilmann | 430/467 |
| 3,996,054 | 12/1976 | Santemma et al. | 430/377 |
| 4,035,188 | 7/1977 | Yabata et al. | 430/467 |
| 4,264,716 | 4/1981 | Vincent et al. | 430/380 |
| 4,299,914 | 11/1981 | Fujumatsu et al. | 430/552 |
| 4,304,844 | 12/1981 | Fujumatsu et al. | 430/552 |
| 4,336,324 | 6/1982 | Koboshi et al. | 430/372 |
| 4,443,536 | 4/1984 | Lestina | 430/552 |
| 4,524,132 | 6/1985 | Aoki et al. | 430/552 |
| 4,526,861 | 7/1985 | Ichijima et al. | 430/385 |
| 4,529,690 | 7/1985 | Ohbayashi et al. | 430/551 |
| 4,564,590 | 1/1986 | Sasaki et al. | 430/552 |
| 4,565,777 | 1/1986 | Ogawa et al. | 430/552 |
| 4,567,134 | 1/1986 | Koboshi et al. | 430/372 |

FOREIGN PATENT DOCUMENTS

| | | | |
|---|---|---|---|
| 211437 | 2/1987 | European Pat. Off. . | |
| 2650764 | 5/1977 | Fed. Rep. of Germany | 430/380 |
| 29461 | 8/1974 | Japan . | |
| 52058 | 4/1980 | Japan . | |
| 200037 | 12/1982 | Japan . | |
| 42045 | 3/1983 | Japan . | |
| 50536 | 3/1983 | Japan . | |
| 48755 | 3/1984 | Japan . | |
| 174836 | 10/1984 | Japan . | |
| 177553 | 10/1984 | Japan . | |
| 177555 | 10/1984 | Japan . | |
| 177556 | 10/1984 | Japan . | |
| 177557 | 10/1984 | Japan . | |
| 178459 | 10/1984 | Japan . | |
| 19140 | 1/1985 | Japan . | |
| 158444 | 8/1985 | Japan . | |
| 158446 | 9/1985 | Japan | 430/464 |
| 030250 | 2/1987 | Japan . | |
| 177554 | 10/1989 | Japan . | |

*Primary Examiner*—Paul R. Michl
*Assistant Examiner*—Patrick A. Doody
*Attorney, Agent, or Firm*—Sughrue, Mion, Zinn Macpeak, and Seas

[57] ABSTRACT

A process for processing color photographic papers using a color developer substantially free from benzyl alcohol and containing a compound represented by formula (I)

(I)

wherein Z represents an atomic group forming an aromatic nucleus is disclosed. In the process, the formation of color stains is greatly reduced even in the case of shortening the processing times for the blix step and the wash and/or stabilization step after color development.

15 Claims, No Drawings

PROCESS FOR PROCESSING SILVER HALIDE COLOR PHOTOGRAPHIC MATERIAL USING A DEVELOPER COMPRISING SUBSTANTIALLY NO BENZYL ALCOHOL

FIELD OF THE INVENTION

This invention relates to a process for processing silver halide color photographic materials, and, more particularly, to a process for processing color photographic materials which can be performed for a shortened processing time using a color developer having improved stability.

BACKGROUND OF THE INVENTION

Recently, in the market of color photographic materials, with the shortening the time for delivery of finished color products and the reduction of laboratory work, it has been desired to reduce the processing time for color photographic materials. For shortening the times for various processing steps of color photographic materials, it has been typical to increase the processing temperature and the amounts of replenishers, and it has also been proposed to increase stirring during processing, add various accelerators, etc.

In particular, in the processing process for color photographic material having a reflective support, the processing step itself for the color photographic material is shortened and the processing steps are generally completed, after color development, by a bleach-fix (or blix) step and a wash and/or stabilization step.

However, it has been found that in the shortened process involving reducing the number of processing steps or shortening each processing time described above, and, in particular, in the shortened process wherein the time for blix step is shorter than about 1 minute and the time for washing and/or stabilization is shorter than about 2 minutes, there occurs a new problem that the processed color photographic materials suffer the increase of the formation of stain in the case of continuous processing. Also, the aforesaid problem is particularly severe in the case of practicing a water saving process as the case of greatly reducing the amount of water for wash step, etc. Such a stain is particularly visually perceivable in reflective color photographic materials, including color photographic papers, and hence the increase of the formation of stain inevitably results in severe problems in the case of such color photographic materials.

From the facts that the aforesaid stain is removed by rewashing the color photographic material once processed, the formation of stain can be prevented by sufficiently prolonging the time for washing, etc., and stain does not form when a fresh color developer is used, it is thought that the occurrence of stain is based on the insufficient washing out of the oxidized components of color developer attached to the color photographic materials.

In an attempt to increase the rate of color development of color developing solutions, various methods have hitherto been proposed. In particular, there have been proposed various additives for accelerating penetration of a color developing agent into coupler-containing oil droplets, where the color developing agent finally undergoes coupling with the coupler to form a dye. Among these additives, benzyl alcohol known to produce a particularly great effect in color formation acceleration, and has been employed for processing of various types of color photographic lightsensitive materials, and is still used widely for processing of color papers.

Since benzyl alcohol has poor solubility, though it is soluble in water to some extent, diethylene glycol, triethylene glycol, or an alkanolamine may be employed in combination to increase the solubility.

Further, various preservatives and chelating agents have been investigated for improving the stability of color developer. For example, as preservatives, there are provided aromatic polyhydroxy compounds described in Japanese Patent Application (OPI) Nos. 49828/77, 160142/84, 47038/81 (the term "OPI" as used herein refers to a "published unexamined Japanese patent application"), etc., and U.S. Pat. No. 3,746,544, etc., hydroxycarbonyl compounds described in U.S. Pat. 3,615,503, British Pat. No. 1,306,176, etc., Δ-aminocarbonyl compounds described in Japanese Patent Application (OPI) Nos. 143020/77, 89425/78, etc., alkanolamines described in Japanese Patent Application (OPI) No. 3532/79, etc., metal salts described in Japanese Patent Application (OPI) Nos. 44148/82, 53749/82, etc. Also, as chelating agents, there are provided aminopolycarboxylic acids described in Japanese Patent Publication Nos. 30496/73, 30232/69, etc., organic phosphonic acids described in Japanese Patent Application (OPI) No. 97347/81, Japanese Patent Publication No. 39359/81, West German Pat. No. 2,227,639, etc., phosphonocarboxylic acids described in Japanese Patent Application (OPI) Nos. 102726/77, 42730/78, 121127/79, 126241/80, 65956/80, etc., and compounds described in Japanese Patent Application (OPI) Nos. 195845/83 and 203440/83, Japanese Patent Publication No. 40900/78, etc.

However, when the aforesaid compounds are added to an ordinary color developer containing benzyl alcohol for developing reflective color photographic materials, it has not yet been possible to fully sufficiently prevent the occurrence of stain when processing in a very short period of time although some effect may be obtained according to the nature of the compounds.

SUMMARY OF THE INVENTION

An object of this invention is, accordingly, to provide a processing process for color photographic materials having stabilized performance.

Other object of this invention is to provide a processing process for color photographic materials, which shows stabilized performance without forming stain even in shortened processing times (in particular, blixing time, and washing and/or stabilization time, etc.).

It has now been discovered that the aforesaid objects of this invention can be attained by a process for processing a silver halide color photographic material, which comprises processing a silver halide color photographic material having at least one silver halide emulsion layer on a reflective support with a color developer containing substantially no benzyl alcohol and containing at least one kind of a compound represented by formula (I)

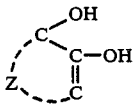

(I)

wherein Z represents an atomic group forming an aromatic nucleus.

In a preferred embodiment of the process of this invention, the color photographic material is, after color development, blixed and then washed, stabilized, or washed and stabilized, with the time for the blix processing step being 1 minute or less, and the total time for the washing and stabilization being 2 minutes or less.

In other preferred embodiment of the process of this invention, the amount of replenisher of wash water or a stabilizing liquid in the washing or stabilization processing step is from 0.1 to 50 times the amount of the liquid carried thereinto from a prebath per unit area of color photographic material.

DETAILED DESCRIPTION OF THE INVENTION

The invention is explained below in further detail.

The aromatic polyhydroxy compound for use in this invention is a compound having at least two hydroxy groups on the aromatic ring at positions ortho to each other. Also, the aromatic polyhydroxy compound is preferably a compound having at least two hydroxy groups on the aromatic ring at positions ortho to each other and having no exocyclic saturation. The aromatic polyhydroxy compounds for use in this invention include the benzene compounds and naphthalene compounds represented by the formula

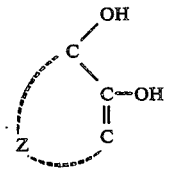

wherein Z represents an atomic group completing a substituted or unsubstituted aromatic nucleus of benzene or naphthalene.

The aromatic polyhydroxy compound described above may further have substituent(s) such as a sulfo group (including an ester or a salt thereof), a carboxy group (including an ester or a salt thereof), and a halogen atom in addition to the hydroxy groups, with a sulfo group being preferred. The number of the substituents other than the hydroxy group is preferably 1 to 3.

Examples of the aromatic polyhydroxy compounds which are preferably used in this invention are listed below.

I-(1): Pyrocatechol
I-(2): 4,5-Dihydroxy-m-benzenedisulfonic acid
I-(3): 4,5-Dihydroxy-m-benzenedisulfonic acid disodium salt
I-(4): Tetrabromopyrocatechol
I-(5): Pyrogallol
I-(6): Gallic acid
I-(7): Methyl gallate
I-(8): Propyl gallate
I-(9): 2,3-Dihydroxynaphthalene-6-sulfonic acid
I-(10): 2,3,8-Trihydroxynaphthalene-6-sulfonic acid
I-(11): 4,5-Dihydroxy-1,3,6-benzenetrisulfonic acid trisodium salt
I-(12): 4,5-Dihydroxy-1,2,3-benzenetrisulfonic acid trisodium salt The aromatic polyhydroxy compound is present in a color developer generally in an amount of from 0.00005 to 0.1 mol, preferably from 0.0002 to 0.04 mol, and more preferably from 0.0002 to 0.004 mol, per liter of the color developer.

It is known to process color photographic materials with a color developer containing the abovedescribed aromatic polyhydroxy compound which is used in this invention as described, for example, in U.S. Pat. No. 4,264,716. However, in the process of shortening the processing times for the processing steps after color development, the increase of the formation of stain can not be sufficiently inhibited simply by using the aforesaid compound.

The inventors have confirmed that the formation of the stain is based on attachment of oxidized components of a color developer, and benzyl alcohol, which is a normal component for a color developer, is involved with the formation of the attachment thereof.

Thus, it can be said to be difficult to expect that the formation of stain in the case of employing processing of short period of time can be effectively inhibited by only the case of incorporating the aromatic polyhydroxy compound shown by formula (I) described above in a color developer containing substantially no benzyl alcohol.

The color developer for use in this invention contains an aromatic primary amine color developing agent. Preferred examples of the color developing agent are p-phenylenediamine derivatives and specific examples thereof are listed below, but the color developing agents for use in this invention are not limited to these compounds.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)amino]aniline
D-6: N-Ethyl-N-(β-methanesulfonamidoethyl)-3-methyl-4-aminoaniline
D-7: N-(2-Amino-5-diethylaminophenylethyl)methanesulfonamide
D-8: N,N-Dimethyl-p-phenylenediamine
D-9: 4-Amino-3-methyl-N-ethyl-N-methoxyethylaniline D-10: 4-Amino-3-methyl-N-ethyl-N-β-ethoxyethylaniline D-11: 4-Amino-3-methyl-N-ethyl-N-β-butoxyethylaniline Also, these p-phenylenediamine derivatives may be used in the form of the salts thereof, such as sulfates, hydrochlorides, sulfites, p-toluenesulfonates, etc. The amount of the aromatic primary amine developing agent is preferably from about 0.1 g to about 20 g, and more preferably from about 0.5 g to about 10 g, per liter of the color developer.

The color developer for use in this invention may further contain a hydroxylamine.

The hydroxylamine may be used in the form of free amine in a color developer, but is generally used in the form of water-soluble acid salt. Examples of such salts are sulfates, oxalates, chlorides, phosphates, carbonates, acetates, etc. The hydroxylamines may be substituted or unsubstituted or further the nitrogen atom(s) of the hydroxylamines may be substituted by alkyl group(s).

The hydroxylamines for use in this invention are represented by formula (II)

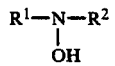

(II)

wherein $R^1$ and $R^2$ each represents a hydrogen atom, a substituted or unsubstituted alkyl group, a substituted or unsubstituted alkenyl group, or a substituted or unsubstituted aryl group, or $R^1$ and $R^2$ together form a heterocyclic ring with the nitrogen atom.

It is preferred that $R^1$ and $R^2$ are an alkyl group or an alkenyl group, and it is more preferred that at least one of said $R^1$ and $R^2$ has a substituent.

The alkyl group or the alkenyl group shown by $R^1$ and $R^2$ may be a straight chain, branched, or cyclic group which may be substituted by, for example, a halogen atom (e.g., a fluorine atom, a chlorine atom, a bromine atom, etc.), an aryl group (e.g., a phenyl group, a p-chlorophenyl group, etc.), an alkoxy group (e.g., a methoxy group, an ethoxy group, a methoxyethoxy group, etc.), an aryloxy group (e.g., a phenoxy group, etc.), a sulfonyl group (e.g., a methanesulfonyl group, a p-toluenesulfonyl group, etc.), a sulfonamido group (e.g., a methanesulfonamido group, a benzenesulfonamido group, etc.), a sulfamoyl group (e.g., a diethylsulfamoyl group, an unsubstituted sulfamoyl group, etc.), a carbamoyl group (e.g., an unsubstituted carbamoyl group, a diethylcarbamoyl group, etc.), an amido group (e.g., a phetoamido group, a benzamido group, etc.), a ureido group (e.g., a methylureido group, a phenylureido group, etc.), an alkoxycarbonylamino group (e.g., a methoxycarbonylamino group, etc.), an aryloxycarbonylamino group (e.g., a phenoxycarbonylamino group, etc.), an alkoxycarbonyl group (e.g., a methoxycarbonyl group, etc.), an aryloxycarbonyl group (e.g., a phenoxycarbonyl group, etc.), a cyano group, a hydroxy group, a carboxy group, a sulfo group, a nitro group, an amino group (e.g., an unsubstituted amino group, a diethylamino group, etc.), an alkylthio group (e.g., a methylthio group, etc.), an arylthio group (e.g., a phenylthio group, etc., and a heterocyclic group (e.g., a morpholyl group, a pyridyl group, etc.).

$R^1$ and $R^2$ may be the same or different, and further the substituents of $R^1$ and $R^2$ may be the same or different.

Also, the carbon atom number of $R^1$ or $R^2$ is preferably from 1 to 10, and more preferably from 1 to 5.

Moreover, examples of the nitrogen-containing heterocyclic ring formed by the combination of $R^1$ and $R^2$ are a piperidyl group, a pyrrolidyl group, an N-alkylpiperadyl group, a morpholyl group, an indolinyl group, a benztriazolyl group, etc.

Examples of the preferred substituents for $R^1$ and $R^2$ are a hydroxy group, an alkoxy group, a sulfonyl group, an amido group, a carboxy group, a cyano group, a sulfo group, a nitro group, and an amino group.

Specific examples of the hydroxylamines represented by formula (II) are illustrated below, but the scope of this invention is not limited to these compounds. II-(1):

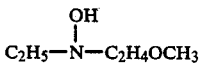
II-(1)

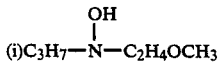
II-(2)

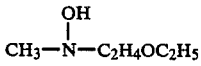
II-(3)

-continued

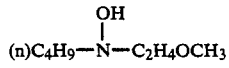
II-(4)

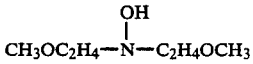
II-(5)

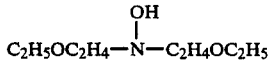
II-(6)

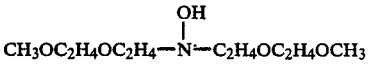
II-(7)

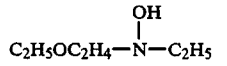
II-(8)

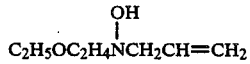
II-(9)

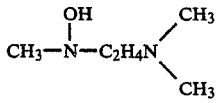
II-(10)

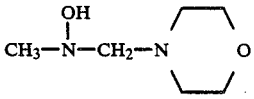
II-(11)

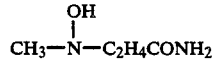
II-(12)

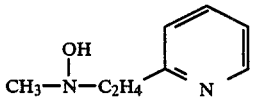
II-(13)

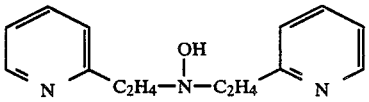
II-(14)

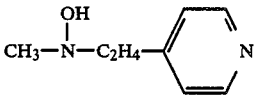
II-(15)

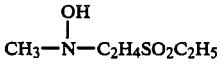
II-(16)

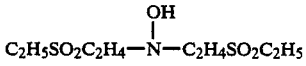
II-(17)

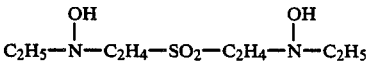
II-(18)

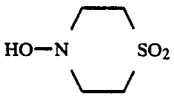
II-(19)

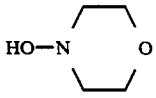
II-(20)

-continued

II-(21)

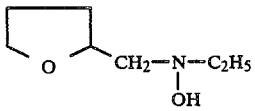

II-(22)

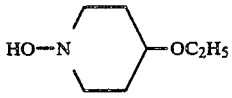

II-(23)

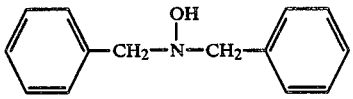

II-(24)

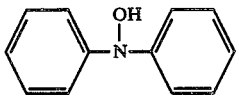

II-(25)

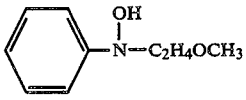

II-(26)

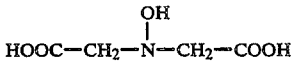

II-(27)

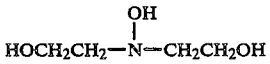

II-(28)

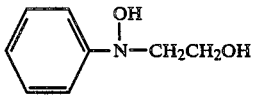

II-(29)

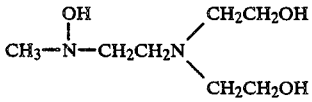

II-(30)

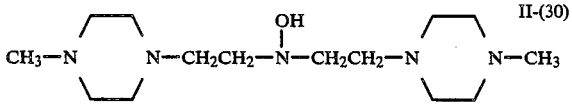

II-(31)

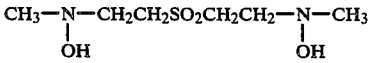

II-(32)

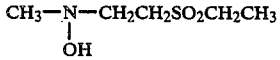

II-(33)

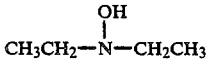

II-(34)

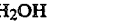

The hydroxylamines represented by formula (II) described above can be synthesized by the methods described, for example, in U.S. Pat. Nos. 3,661,996, 3,362,961, 3,293,034, 3,491,151, 3,655,764, 3,467,711, 3,455,916, 3,287,125, 3,287,124, Japanese Patent Publication No. 2794/67, etc.

These hydroxylamines may be used in the form of salts with various acids such as hydrochloric acid, sulfuric acid, nitric acid, phosphoric acid, oxalic acid, acetic acid, etc.

The addition amount of the hydroxylamine is preferably from 0.1 g to 20 g, and more preferably from 0.5 g to 10 g, per liter of the color developer.

Also, it is preferred that the color developer for use in this invention contains a sulfite such as sodium sulfite, potassium sulfite, sodium hydrogensulfite, potassium hydrogensulfite, sodium metasulfite, potassium metasulfite, etc., or carbonyl sulfite addition products as a preservative. The addition amount of the preservative is less than 20 g/liter, and preferably less than 5 g/liter.

As other preservatives, there are hydroxyacetones described in U.S. Pat. No. 3,615,503, British Pat. No. 1,306,176, α-aminocarbonyl compounds described in Japanese Patent Application (OPI) Nos. 143020/77, 89425/78, etc., various kinds of metal salts described in Japanese Patent Application (OPI) Nos. 44148/82, 53749/82, etc., hydroxamic acids described in Japanese Patent Application (OPI) No. 27638/77, α,α'-dicarbonyl compounds described in Japanese Patent Application (OPI) No. 160141/84, salicylic acids described in Japanese Patent Application (OPI) No. 180588/84, alkanolamines described in Japanese Patent Application (OPI) No. 3532/79, poly(alkyleneimine) described in Japanese Patent Application (OPI) No. 94349/81, gluconic acid derivatives described in Japanese Patent Application (OPI) No. 75647/81, etc.

The aforesaid preservatives may be used singly or as a combination thereof. In these compounds, alkanolamines and salicylic acids are particularly preferred.

The pH of the color developer for use in this invention is preferably from about 9 to about 12, more preferably from about 9 to about 11.0 and also the color developer may further contain various additives which are ordinarily employed for color developers.

For maintaining the aforesaid pH of color developer, it is preferred to use various buffers. As such buffers, there are carbonates, phosphates, borates, tetraborates, hydroxybenzoates, glucine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc. In particular, carbonates, phosphates, tetraborates, and hydroxybenzoates are preferred since they are excellent in solubility, and also the buffering action at the high pH range of higher than 9.0, they result in no adverse influences (e.g., the formation of fog, etc.) to the photographic performance when they are added to the color developer, and they are available at low cost.

Specific examples of these buffers include sodium carbonate, potassium carbonate, sodium hydrogencarbonate, potassium hydrogencarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the present invention is not limited to these compounds. The addition amount of the buffer is preferably not less than 0.1 mol, and more preferably from 0.1 mol to 0.4 mol, per liter of the color developer.

Furthermore, the color developer for use in this invention can contain various chelating agents as a precipitation preventing agent for calcium and magnesium, and for improving the stability of the color developer.

As the chelating agent, organic acid compounds are preferred, and examples of such chelating agents include aminopolycarboxylic acids described in Japanese Patent Publication Nos. 30496/73 and 30232/79, organic phosphonic acids described in Japanese Patent Application (OPI) No. 97347/81, Japanese Patent Publication No. 39359/81, and West German Patent 2,227,639, phosphonocarboxylic acids described in Japanese Patent Application (OPI) Nos. 102726/77, 42730/78, 121127/79, 126241/80 and 65956/80, and compounds described in Japanese Patent Application (OPI) Nos. 195845/83, 203440/83, and Japanese Patent Publication No. 40900/78.

Specific examples of the chelating agent are illustrated below, but the invention is not limited to these compounds.

C-1: Nitrilotriacetic acid
C-2: Diethylenetriaminepentaacetic acid
C-3: Ethylenediaminetetraacetic acid
D-4: Triethylenetetraminehexaacetic acid
D-5: Nitrilo-N,N,N-trimethylenephosphonic acid
C-6: Ethylenediamine-N,N,N',N'-tetramethylenephosphonic acid
C-7: 1,3-Diamino-2-propanoltetraacetic acid
C-8: Transcyclohexanediaminetetraacetic acid
C-9: Nitrilotripropionic acid
C-10: 1,2-Diaminopropanetetraacetic acid
C-11: Hydroxyethyliminodiacetic acid
C-12: Glycol ether diaminetetraacetic acid
C-13: Hydroxyethylenediaminetriacetic acid
C-14: Ethylenediamineorthohydroxyphenylacetic acid
C-15: 2-Phosphonobutane-1,2,4-tricarboxylic acid
C-16: 1-Hydroxyethylidene-1,1-diphosphonic acid
C-17: N,N'-Bis(2-hydroxybenzyl)ethylenediamine-N,N'diacetic acid These chelating agents may be used, if desired, as a mixture thereof.

The amount of the chelating agent(s) may be one sufficient for blocking metal ion(s) in a color developer, and is generally from about 0.1 g to about 10 g per liter of the color developer.

The color developer for use in this invention contains substantially no benzyl alcohol as development accelerator, that is, contains not more than about 0.5 ml/liter of benzyl alcohol. It is preferred in this invention that the color developer contains no benzyl alcohol. However, the color developer may contain development accelerators other than benzyl alcohol.

Examples of development accelerators which can be used for the color developer include thioether compounds described in Japanese Patent Publication Nos. 16088/62, 5987/62, 7826/63, 12380/69, 9019/70, U.S. Pat. No. 3,813,247, etc., p-phenylenediamine series compounds described in Japanese Patent Application (OPI) Nos. 49829/77, 15554/75, etc., quaternary ammonium salts described in Japanese Patent Application (OPI) Nos. 137726/75, 156826/81, 43429/77, Japanese Patent Publication No. 30074/69, etc., p-aminophenols described in U.S. Pats. Nos. 2,610,122, 4,119,462, etc., amine series compounds described in U.S. Pats. No. 2,494,903, 3,128,182, 4,230,796, 3,253,919, 2,482,546, 2,596,926, 3,582,346, Japanese Patent Publication No. 11431/66, etc., polyalkylene oxides described in Japanese Patent Publication Nos. 16088/62, 25201/67, 11431/66, 23883/67, U.S. Pats. Nos. 3,128,183, 3,532,501, etc., and also 1-phenyl-3-pyrazolidones, hydrazines, mesoion type compounds, ion type compounds, imidazoles, etc.

The color developer for use in this invention may contain, if desired, an optional antifoggant. As the antifoggant, there are metal halides such as potassium bromide, sodium chloride, potassium iodide, etc., and organic antifoggants. Examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc., mercapto-substituted heterocyclic compounds such as 1-phenyl-5-mercaptotetrazole, 2-mercaptobenzimidazole, 2-mercaptobenzothiazole, etc., and mercapto-substituted aromatic compounds such as thiosalicylic acid, etc. Particularly preferred antifoggants are the nitrogencontaining aromatic compounds. The antifoggant may be accumulated in a color developer dissolved from color photographic materials during processing.

Moreover, it is preferred that the color developer for use in this invention contains an optical whitening agent. Preferred examples of the optical whitening agent are 4,4'-diamino-2,2'-disulfostilbene series compounds. The addition amount of the optical whitening agent is less than 5 g, and preferably from 0.1 g to 2 g, per liter of the color developer.

Still further, the color developer for use in this invention may further contain, if desired, various kinds of surface active agents such as alkylsulfonic acids, arylsulfonic acids, aliphatic carboxylic acids, aromatic carboxylic acids, etc.

The processing temperature for the color developer in this invention is generally from 20° C. to 50° C., and preferably from 30° C. to 40° C. The processing time for the color development is generally from 20 seconds to 5 minutes, and preferably from 30 seconds to 4 minutes. The amount of the replenisher for color developer is preferably as small as possible, but is usually from 20 ml to 600 m], preferably from 50 ml to 300 ml, and more preferably from 100 ml to 200 ml, per square meter of the color photographic material to be processed. The amount of replenisher primarily corresponds to the amount of processing solution overflowing from the processing bath, evaporating from the bath, and being carried to a postbath, in total.

In this invention, the color photographic materials are subjected to blix processing after color development.

In this invention, the processing time for the blix step can be reduced below about 1 minute, which is greatly shortened as compared with the processing time for a conventional blix step (about 1 minute and 30 seconds). In this case, the processing time for blix step (hereinafter referred to as blix time) is the time required for a color photographic material from being brought into contact with a blix liquid to contact with a subsequent processing liquid such as water for wash step, etc., i.e., it includes the space residence time of the color photographic material, that is, the moving time between the blix bath and the subsequent bath thereof, in addition to the time of presence in the blix liquid. In this invention, the formation of stain, etc., can be inhibited even when the blix time is reduced to from 30 seconds to 60 seconds.

The blix liquid generally contains a sulfate ion releasing compound such as a sulfite (e.g., sodium sulfite, potassium sulfite, ammonium sulfite, etc.), a hydrogensulfite (e.g., ammonium hydrogensulfite, sodium hydrogensulfite, potassium hydrogensulfite, etc.), a metasulfite (e.g., potassium metasulfite, sodium metasulfite, ammonium metasulfite, etc.), etc., as a preservative. The amount of the preservative is preferably from about 0.02 mol to about 0.30 mol, and more preferably from about 0.10 mol to about 0.20 mol, per liter of blix liquid as sulfite ion.

Other preservatives which can be used in this invention include hydroxylamine, hydrazine, hydrogensulfite addition salts of aldehyde compounds (e.g., acetaldehyde sodium hydrogensulfite), etc.

As the bleaching agent which is used for the blix liquid in this invention, there are organic complex salts of iron (III) (e.g., the complex salts of aminopolycarboxylic acids such as ethylenediaminetetraacetic acid, diethylenetriaminepentaacetic acid, etc., and organic phosphonic acids such as aminopolyphosphonic acid, phosphonocarboxylic acid, etc.); organic acids such as citric acid, tartaric acid, malic acid, etc.; persulfates; hydrogenperoxide, etc. In these materials, the organic complex salts of iron(III) are preferred from the viewpoints of quick processing and the prevention of environmental pollution.

Examples of aminopolycarboxylic acids, aminopolyphosphonic acids, organic phosphonic acids, and salts thereof useful for forming the organic complex salts of iron(III) are illustrated below.

Ethylenediaminetetraacetic acid,
Diethylenetriaminepentaacetic acid,
Ethylenediamine-N-(β-oxyethyl)-N,N',N'-triacetic acid,
1,3-Diaminopropanetetraacetic acid,
Triethylenetetraminehexaacetic acid,
Propylenediaminetetraacetic acid,
Nitrilotriacetic acid,
Nitrilotripropionic acid,
Cyclohexanediaminetetraacetic acid,
1,3-Diamino-2-propanoltetraacetic acid,
Methyliminodiacetic acid,
Iminodiacetic acid,
Hydroxyliminodiacetic acid,
Dihydroxyethylglycine ethyl ether diaminetetraacetic acid,
Glycol ether diaminetetraacetic acid,
Ethylenediaminetetrapropionic acid,
Ethylenediaminedipropionic acid,
Phenylenediaminetetraacetic acid,
2-Phosphonobutane-1,2,4-triacetic acid,
1,3-Diaminopropanol-N,N,N',N'-tetramethylenephosphonic acid,
Ethylenediamine-N,N,N',N'-tetramethylenephosphonic acid,
1,3-Propylenediamine-N,N,N',N'-tetramethylenephosphonic acid,
1-Hydroxyethylidene-1,1-diphosphonic acid, etc.

These compounds may be in the forms of sodium salts, potassium salts, lithium salts, or ammonium salts. In the aforesaid compounds, the iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferred due to their high bleaching power.

The amount of the bleaching agent is preferably from 0.15 mol to 0.5 mol, and more preferably from 0.2 mol to 0.4 mol, per mol of blix liquid from the purpose of quick processing.

As a fixing agent which is used for the blix liquid in this invention, there are thiosulfates such as sodium thiosulfate, ammonium thiosulfate, etc.; thiocyanates such as sodium thiocyanate, ammonium thiocyanate, etc.; thioether compounds such as ethylenebisthioglycolic acid, 3,6-dithia-1,8-octanediol, etc., and thioureas, which are known as water-soluble silver halide dissolving agents. They can be used singly or as a mixture thereof. Also, a specific blix liquid composed of a combination of the fixing agent described in Japanese Patent Application (OPI) No. 155354/80 and a large amount of a halide such as potassium iodide can be used in this invention.

In this invention, the use of a thiosulfate, in particular, ammonium thiosulfate is preferred.

The amount of the fixing agent is preferably from about 0.3 mol to about 2 mols, and more preferably from 0.5 mol to 1.0 mol, per liter of blix liquid.

The pH range of the blix liquid for use in this invention is preferably from about 4 to about 8, and more preferably from about 5 to about 7.5. If the pH of the blix liquid is lower than the aforesaid range, the deterioration of the liquid and the conversion of cyan dyes into leuco compounds are accelerated although the desilvering power is improved. On the other hand, if the pH is higher than the aforesaid range, the desilvering power is lowered and stain is liable to occur.

For controlling the pH of the blix liquid, if necessary, hydrochloric acid, sulfuric acid, nitric acid, acetic acid, hydrogencarbonates, ammonia, potassium hydroxide, sodium hydroxide, sodium carbonate, potassium carbonate, etc., may be added to the blix liquid.

Also, the blix liquid for use in this invention may contain various kinds of optical whitening agents, defoaming agents, surface active agents or organic solvents (e.g., polyvinylpyrrolidone, methanol, etc.).

Furthermore, if desired, the blix liquid may further contain a bleach accelerator. Examples of useful bleach accelerators include compounds having a mercapto group or a disulfide group as described in U.S. Pat. No. 3,893,858, West German Pats. Nos. 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78 and 28426/78, Research Disclosure, RD No. 17129 (July, 1978), etc., thiazolidine derivatives described in Japanese Patent Application (OPI) No. 140129/75, etc., thiourea derivatives described in Japanese Patent Publication No. 8506/70, Japanese Patent Application (OPI) Nos. 20832/77 and 32735/78, U.S. Pat. No. 3,706,561, etc., iodides described in West German Pat. No. 1,127,715, Japanese Patent Application (OPI) No. 16235/83, etc., polyethylene oxides described in West German Pats. Nos. 966,410, 2,748,430, etc., polyamine compounds described in Japanese Patent Publication No. 8836/70, compounds described in Japanese Patent Application (OPI) Nos. 42434/74, 59644/74, 94927/78, 35727/79, 26506/80, 163940/83, etc., and iodide ions, bromide ions, etc. In these compounds, the compounds having a mercapto group or a disulfide group described above are preferred from the viewpoint of attaining large acceleration effect. In particular, the compounds described in U.S. Pat. No. 3,893,858, West German Pat. No. 1,290,812 and Japanese Patent Application (OPI) No. 95630/78 are preferred.

The blix liquid for use in this invention may further contain a rehalogenating agent such as a bromide (e.g., potassium bromide, sodium bromide, ammonium bromide, etc.), a chloride (e.g., potassium chloride, sodium chloride, ammonium chloride, etc.), and an iodide (such as ammonium iodide, etc.). Furthermore, if desired, the blix liquid may contain a corrosion inhibitor such as inorganic or organic acids having a pH buffer action or the alkali metal salts and ammonium salts thereof (e.g., boric acid, borax, sodium metaborate, acetic acid, sodium acetate, sodium carbonate, potassium carbonate, phosphorous acid, phosphoric acid, sodium phosphate, citric acid sodium citrate, tartaric acid, etc.), ammonium nitrate, guanidine, etc.

The processing temperature for the blix step in this invention is generally from 10° C. to 50° C., and preferably from 20° C. to 40° C. Also, the amount of the replenisher for the blix liquid is generally from 20 ml to 600 ml, and preferably from 30 ml to 200 ml, per square meter of the color photographic material.

After the desilvering step (blix), the color photographic material thus processed is subjected to washing (including washing with a small amount of water, rinsing, etc.), stabilization, or washing and stabilization. In this case, the processing time for the wash and/or stabilization step is the same as defined above for the case of the blix step. However, when the wash and/or stabilization step is composed of plural tanks, the processing time is the sum of the processing times for these tanks. The processing time for wash and/or stabilization step requires at least 3 minutes in conventional processing process, but the processing time can be reduced below 2 minutes in the process of this invention.

For the wash and/or stabilization step in this invention, various kinds of compounds can be used for various purposes. For example, it is known to use antibacterial agents and antifungal agents for preventing the generation of bacteria, molds, and algae. Examples of such antibacterial agents and antifungal agents are the compounds described in *Journal of Antibacterial and Antifungal Agents,* Vol. 11, No. 5, pp. 207–223 (1983), Hiroshi Horiguchi, *Bokin Bobai no Kagaku* (*Antibacterial and Antifungal Chemistry*), etc. Also, other antibacterial agents and antifungal agents are described in Japanese Patent Application (OPI) Nos. 8543/82, 58143/82, 97530/82, 105145/83, 134636/83, 91440/84, 126533/84, 184344/84, 185336/84, 239750/85, 239751/85, 247241/85, 260952/85, 2149/86, 28947/86 and 28945/86, Japanese Patent Application Nos. 158475/84, 105487/85, etc., together with the methods of using these materials.

Specific examples of particularly useful antibacterial and antifungal agents are isothiazolone derivatives (e.g., 2-octyl-4-isothiazolin-3-one, 5-chloro-2-methyl-4-isothiazolin-3-one, etc.), sulfanylamide derivatives (e.g., sulfanylamide, etc.), and benzotriazole derivatives (e.g., benzotriazole, 5-methylbenzotriazole, 5-chlorobenzothiazole, etc.).

Also, it is known to add a chelating agent to wash water or a stabilizing liquid for improving the stability of color images after processing. Examples of useful chelating agents are inorganic phosphoric acids, organic carboxylic acids, aminopolycarboxylic acids, and organic phosphonic acids, and specific examples thereof are described in Japanese Patent Application (OPI) Nos. 8543/82, 197540/82, 14834/83, 134636/83, 126533/84, 184343/84, 184344/84, 184345/84, 185336/84, 135942/85, 238832/85, 239748/85, 239749/85, 239750/85, 239751/85, 242458/85, 262161/85, 4047/86, 4050/86, 4051/86, 4052/86, 4053/86, 4054/86, 28942/86 and 28945/86 together with the methods of using them.

Particularly useful chelating agents are ethylenediaminetetraacetic acid, diethylenetriaminepentaacetic acid, nitrilotriacetic acid, 1-hydroxyethylidene1,1'-diphosphonic acid, ethylenediaminetetramethylphosphonic acid, etc.

Also, a metal compound may be used together with the aforesaid chelating agent for the wash and/or stabilization step. Examples of such metal compounds include bismuth compounds as described in Japanese Patent Application (OPI) No. 134636/83, etc., compounds of Ba, Ca, Ce, Co, In, La, Mn, Ni, Pb, Ti, Sn, Zn and Zr described in Japanese Patent Application (OPI) No. 184344/84, etc., and compounds of Mg, Al and Sr described in Japanese Patent Application (OPI) No. 185336/84, etc. In these compounds, the compounds of Bi, Ca, Mg and Al are particularly useful. Also, a copper compound may be added together with the chelating agent as an antibacterial agent.

Furthermore, for effectively performing the wash processing, a method of using a surface active agent (Japanese Patent Application (OPI) No. 197540/82) can be used and also for removing components giving bad influences on the photographic performance, a method of contacting the wash water or stabilizing liquid with ion exchange resins (Japanese Patent Application (OPI) No. 220345/85), a method of applying a back osmosis method (Japanese Patent Application (OPI) No. 241053/85), a method of contacting with activated carbon, a clay material, a polyamide series polymer, a polyurethane series polymer, a phenol resin, an epoxy resin, a polymer having a hydrazide group, a polymer containing polytetrafluoroethylene, or a copolymer of a monohydric or polyhydric alcohol methacrylic acid ester and a polyhydric alcohol methacrylic acid polyester (Japanese Patent Application (OPI) No. 263151/85), and a method of applying electrodialysis (Japanese Patent Application (OPI) No. 28949/86) can be employed.

Furthermore, a method of applying ultraviolet irradiation or magnetic field to the wash water or stabilizing liquid can be employed as a method preventing the generation of bacteria and molds. Moreover, in the case of continuously processing color photographic materials, the processes described in Japanese Patent Application (OPI) Nos. 233651/85, 235133/85, 263941/85, 4048/86, 4049/86, 4055/86, 4056/86, 4057/86, 4058/86, 4060/86, etc., can be applied.

The wash water and stabilizing liquid may further contain an optical whitening agent, a hardening agent, etc., in addition to the aforesaid additives.

Also, it is preferred for improving the stability or storability of color images formed to add various ammonium salts such as ammonium chloride, ammonium nitrate, ammonium sulfate, ammonium phosphate, ammonium sulfite, ammonium thiosulfate, etc., to the wash water or stabilizing liquid as a pH controlling agent for photographic layers after processing.

Various additives described above may be used as a mixture thereof for the same or different purposes. The addition amount(s) thereof is preferably as small as possible in the necessary range for attaining the purpose(s) from the point of not reducing the emulsion layer properties (occurrence of stickiness, etc.) of the color photographic materials after processing.

It is preferred that the wash and/or stabilization step is performed by a multistage countercurrent system using, for example, 2 to 4 tanks to reduce the amount of replenisher. The amount of the replenisher of the wash water or the stabilizing liquid is preferably from 0.1 to 50 times, and more preferably from 3 to 30 times the amount of a liquid carried from the prebath per unit area of the color photographic material. The amount of the liquid carried from the prebath is generally from 20 ml to 100 ml, and preferably from 25 ml to 80 ml, per square meter of the color photographic material.

The processing time for the wash and/or stabilization step in this invention differs according to the kind of color photographic light-sensitive materials and the processing conditions therefor, but the total processing time is preferably from 20 seconds to 2 minutes, more preferably from 20 seconds to 1 minute and 30 seconds.

The processing temperature for the wash and/or stabilization step in this invention is from 20° C. to 45° C., preferably from 25° C. to 40° C., and more preferably from 30° C. to 35° C.

For increasing the washing out effect of components in the photographic layers of a color photographic material during the wash and/or stabilization step, it is preferred to perform circulation and stirring of the liquid. In particular, it is preferred to employ a method of strongly striking the surface of the emulsion layer of color photographic material by liquid stream (e.g., gas stirring, liquid spraying, etc.).

In this invention, each processing bath or tank may, if desired, be equipped with a heater, a temperature sensor, a liquid level sensor, a circulation pump, a filter, a floating lid, a squeegee, a nitrogen stirrer, an air stirrer, etc.

Silver halide emulsion for use in this invention contains silver bromide, silver chlorobromide, or silver chloride each substantially containing no silver iodide. A preferred silver halide is silver chlorobromide containing from 2 mol % to 99 mol % silver chloride.

In the case of performing quick processing and low replenisher processing, a silver chlorobromide emulsion containing at least 60 mol % silver chloride or a silver chloride emulsion is preferred, and those containing from 80 mol % to 100 mol % of silver chloride are particularly preferred. Also, in the case of requiring high sensitivity and restraining the formation of fog as low as possible during the production, storage and/or processing of color photographic material, a silver chlorobromide emulsion containing at least 50 mol % silver bromide or a silver bromide emulsion is preferred and also it is more preferred that the content of silver bromide is higher than 70 mol %. When the content of silver bromide is over 90 mol %, it becomes difficult to effectively perform quick processing for the color photographic materials but by employing a development accelerating means of using a development accelerator such as a silver halide solvent, a fogging agent, a developing agent, etc., as will be described hereinafter, the development process can be quickened to some extent without being restricted by the content of silver bromide and such a case is sometimes preferred. In any case, it is not preferred that the silver halide emulsion contains a large amount of silver iodide and it is better that the content of silver iodide is less than 3 mol %.

The silver halide grains for use in this invention may have a regular crystal form such as cubic, octahedral, dodecahedral, tetradecahedral, etc., a mixture thereof, an irregular crystal form such as spherical, etc., or a composite form of these crystal forms. Also, the silver halide grains may be tabular grains and in this case, a tabular grain silver halide emulsion wherein tabular silver halide grains having an aspect ratio (length/thickness) of at least 5 (that is, at least 5/1), and preferably at least 8, account for at least 50% of the total projected area of the silver halide grains can be used in this invention. A mixture of these silver halide emulsions each containing silver halide grains having different crystal form may also be used. The silver halide emulsion may be of a surface latent image type of forming latent images mainly on the surface thereof or of an internal latent image type of forming latent images mainly in the inside of the grains.

The silver halide grains for use in this invention may have different phase between the inside and the surface layer thereof, may be a multiphase structure having a junction structure, or may be composed of a uniform phase throughout the whole grain. Also, the silver halide grains may be composed of a mixture thereof.

The mean grain size (shown by the diameter of the grains when the grain is spherical or similar to spherical, and shown by the mean value based on the projected area using, in the case of cubic grains, the long side length as the grain size, or shown by the mean value calculated as a sphere in the case of tabular grains) of the silver halide grains for use in this invention is preferably in the range of from 0.1 μm to 2 μm, more preferably from 0.15 μm to 1 μm. The grain size distribution of the silver halide grains may be narrow or broad but the use of a so-called monodisperse silver halide emulsion, wherein the value (coefficient of variation) obtained by dividing the standard deviation in the grain size distribution curve of the silver halide emulsion by the mean grain size of the silver halide grains in the emulsion is within 20% (preferably within 15%), is preferred. Also, for satisfying the desired gradation for the color photographic material, two or more kinds of monodisperse silver halide emulsions (preferably having the above-described coefficient of variation) each having different grain size can be used as a mixture thereof for one emulsion layer or as separate emulsion layers each having substantially the same color sensitivity. Furthermore, two or more kinds of polydisperse silver halide emulsion layers or a combination of the monodisperse silver halide emulsion and a polydisperse silver halide emulsion can be used as a mixture thereof for one emulsion layer or as separate emulsion layers.

The silver halide photographic emulsions for use in this invention can be prepared according to the methods described in P. Glafkides, *Chimie et Physique Photographique,* published by Paul Montel, 1967; G. F. Duffin, *Photographic Emulsion Chemistry,* published by Focal Press, 1966; and V. L. Zelikman et al., *Making and Coating Photographic Emulsion,* published by Focal Press, 1964, etc.

That is, the emulsion can be prepared by an acid method, a neutralization method, an ammonia method, etc., and as a method of reacting a soluble silver salt and a soluble halide, a single jet method, a double jet method, or a combination thereof may be employed. A so-called reverse mixing method of forming silver halide grains in the existence of excess silver ions can also be used. As one system of the double jet method, a so-called controlled double jet method of keeping a constant pAg in a liquid phase of forming silver halide grains can also be used. According to the method, a silver halide emulsion containing silver halide grains having a regular crystal form and substantially uniform grain sizes can be obtained.

Furthermore, a silver halide emulsion prepared by a conversion method including a step of converting a silver halide already formed before finishing the formation of the silver halide grains into a silver halide having small solubility product or a silver halide emulsion to which the similar halogen conversion was applied after finishing the formation of the silver halide grains can also be used in this invention.

During the formation or physical ripening of the silver halide grains, a cadmium salt, a zinc salt, a thallium salt, an iridium salt or a complex salt thereof, a rhodium salt or a complex salt thereof, an iron salt or a complex salt thereof, etc., may exist in the system.

Silver halide emulsions are, after the formation of the silver halide grains, usually physically ripened, desalted, and chemically ripened before coating.

A silver halide solvent (e.g., ammonia, potassium rhodanate, and thioethers and thione compounds described in U.S. Pat. No. 3,271,157, Japanese Patent Application (OPI) Nos. 12360/76, 82408/78, 144319/78, 100717/79, 155828/79, etc.) can be used for the precipitation, physical ripening, and chemical ripening of the silver halide emulsions for use in this invention.

For removing soluble salts from silver halide emulsions after physical ripening, a noodle washing method, a flocculation method, or an ultrafiltration method can be employed.

The silver halide emulsions for use in this invention can be chemically sensitized by a sulfur sensitization method using active gelatin or a sulfurcontaining compound capable of reacting with gelatin (e.g., thiosulfates, thiourea, mercapto compounds, rhodanines, etc.); a reduction sensitization method using a reducing material (e.g., stannous salts, amines, hydrazine derivatives, formamidinesulfinic acid, silane compounds, etc.); a noble metal sensitization method using a metal compound (e.g., gold complex salts and complex salts of metals belonging to group VIII of the Periodic Table, such as Pt, Ir, Pd, Rh, Fe, etc.), or a combination thereof.

The silver halide emulsions for use in this invention are spectrally sensitized by methine dyes, etc., so that the emulsions have desired color sensitivities, i.e., blue sensitivity, green sensitivity, and red sensitivity. The dyes for use include cyanine dyes, merocyanine dyes, complex cyanine dyes, complex merocyanine dyes, holopolar cyanine dyes, hemicyanine dyes, styryl dyes, and hemioxonol dyes. Particularly useful dyes are dyes belonging to cyanine dyes, merocyanine dyes, and complex merocyanine dyes.

For these dyes can be applied nuclei ordinarily utilized for cyanine dyes as basic heterocyclic nuclei. That is, pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing an aliphatic hydrocarbon ring to the aforesaid nuclei, and the nuclei formed by fusing an aromatic hydrocarbon ring to the aforesaid nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei, quinoline nuclei, etc., can be applied for the dyes described above. These nuclei may be substituted on carbon atoms.

For merocyanine dyes or complex merocyanine dyes may be applied 5-membered or 6-membered heterocyclic nuclei such as pyrazolin-5-one nuclei, thiohydantoin nuclei, 2-thiooxazolidine-2,4-dione nuclei, thiazolidine2,4-dione nuclei, rhodanine nuclei, thiobarbituric acid nuclei, etc., as a nucleus having a ketomethylene structure.

These sensitizing dyes may be used singly or as a combination thereof. A combination of sensitizing dyes is frequently used for the purpose of super-colorsensitization. Typical examples of the combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4963/68 and 12375/78, Japanese Patent Application (OPI) Nos. 110618/77, 109925/77, etc.

The silver halide emulsion for use in this invention may contain a dye having no spectral sensitizing activity by itself or a material which does not substantially absorb visible light and shows super-colorsensitizing activity together with the sensitizing dye(s).

The sensitizing dye(s) may be added to a silver halide emulsion in any step during the formation of silver halide grains, before or after the chemical sensitization, during the chemical sensitization, or coating. The addition of the sensitizing dye(s) during the formation of silver halide grains is effective not only for the increase of adsorption thereof but also for the control of the crystal form and the structure in the grains. Also, the addition of the sensitizing dye(s) at the chemical sensitization is effective not only for the increase of the adsorption thereof but also for the control of the chemical sensitizing site and the prevention of the deformation of crystals. Such an addition method is particularly effective in the case of using silver halide emulsions having a high content of silver chloride and also in the case of using silver halide emulsions having high silver bromide content at the surface of the silver halide grains.

Color photographic materials for use in this invention contain color couplers in the silver halide emulsion layers. It is preferred that the color couplers are rendered nondiffusible by a ballast group or by being polymerized. Furthermore, the use of 2-equivalent color couplers the coupling active position of which is substituted by a releasing group is more effective for reducing the amount of silver than the case of using 4-equivalent color couplers having a hydrogen atom at the coupling active position thereof. Couplers providing colored dyes having a proper diffusibility, non-coloring couplers, DIR couplers releasing a deveiopment inhibitor with the coupling reaction or couplers releasing a development accelerator with the coupling reaction thereof can be used for the color photographic materials.

Typical examples of the yellow couplers for use in this invention are oil-protect type acylacetamide series yellow couplers. Specific examples of the couplers are described in U.S. Pats. Nos. 2,407,210, 2,875,057, 3,265,506, etc.

In this invention, 2-equivalent yellow couplers are preferably used and typical examples thereof are oxygen atom-releasing type yellow couplers described in U.S. Pat. Nos. 3,408,194, 3,447,928, 3,933,501, 4,022,620, etc., and nitrogen atom-releasing type yellow couplers described in Japanese Patent Publication No. 10739/83, U.S. Pat. Nos. 4,401,752 and 4,326,024, Research Disclosure, RD No. 18053 (April, 1979), British Pat. No. 1,425,020, West German Patent Application (OLS) Nos. 2,219,917, 2,261,361, 2,329,587, 2,433,812, etc. In these couplers, α-pivaloylacetanilide series yellow couplers are excellent in fastness, in particular, light fastness of the colored dyes formed, while α-benzoylacetanilide series yellow couplers give high coloring density.

As the magenta couplers for use in this invention, there are oil-protect type indazolone series or cyanoacetyl series magenta couplers, preferably 5-pyrazolone series couplers and pyrazoloazole series couplers such as pyrazolotriazole series couplers.

The pyrazolone series couplers having an arylamino group or an acylamino group at the 3-position thereof are preferred from the viewpoint of the hue of the colored dyes and the coloring density and typical examples of the couplers are described in U.S. Pat. Nos. 2,311,082, 2,343,703, 2,600,788, 2,908,573, 3,062,653, 3,152,896, 3,936,015, etc. Preferred releasing groups for the 2-equivalent 5-pyrazolone series magenta couplers include nitrogen atom-releasing gorups described in U.S. Pat. No. 4,310,619 and arylthio groups described in U.S. Pat. No. 4,351,897. Also, 5-pyrazolone series magenta couplers having a ballast group described in European Pat. No. 73,636 give high coloring density.

Pyrazoloazole series magenta couplers include pyrazolobenzimidazoles described in U.S. Pat. No. 3,369,879, preferably pyrazolo(5,1-c)(1,2,4)triazoles described in U.S. Pat. No. 3,725,067, pyrazolotetrazoles described in *Research Disclosure,* RD No. 24220 (June, 1984), and pyrazolopyrazoles described in ibid., RD No. 24230 (June, 1984). From the viewpoint of less yellow side absorption of colored dyes and high light fastness of colored dyes, imidazo(1,2-b)pyrazoles described in European Patent 119,741 are preferred and pyrazolo(1,5-b) (1,2,4)triazoles described in European Pat. No. 119,860 are particularly preferred.

Cyan couplers for use in this invention include oil-protect type naphtholic and phenolic couplers.

The naphtholic cyan couplers include naphtholic couplers described in U.S. Pat. No. 2,474,293 and, preferably oxygen atom-releasing type 2-equivalent naphtholic couplers described in U.S. Pat. Nos. 4,052,212, 4,146,396, 4,228,233 and 4,296,200. Also, specific examples of the phenolic cyan couplers are described in U.S. Pat. Nos. 2,369,929, 2,801,171, 2,772,162, 2,895,826, etc. Cyan couplers having high fastness to moisture and heat are preferably used in this invention, and typical examples thereof are the phenolic cyan couplers having an alkyl group of two or more carbon atoms at the meta-position of the phenol nucleus described in U.S. Pat. No. 3,772,002, 2,5-diacylamino-substituted phenolic cyan couplers described in U.S. Pat. Nos. 2,772,162, 3,758,308, 4,126,396, 4,334,011 and 4,327,173, West German Pat. No. Application (OLS) No. 3,329,729, Japanese Patent Application (OPI) No. 166956/84, etc., and phenolic cyan couplers having a phenylureido group at the 2-position and an acylamino group at the 5-position thereof described in U.S. Pat. Nos. 3,446,622, 4,333,999, 4,451,559, 4,427,767, etc.

In this invention, the graininess of the color images formed can be improved by using a coupler giving colored dye having a proper diffusibility together with the aforesaid coupler(s). About such couplers giving diffusible dyes, specific examples of the magenta couplers are described in U.S. Pat. No. 4,366,237 and British Pat. No. 2,125,570 and specific examples of the yellow, magenta, and cyan couplers are described in European Pat. No. 96,570 and West German Patent Application (OLS) No. 3,234,533.

The dye-forming couplers and the specific couplers described above may form a dimer or higher polymer. Typical examples of the polymerized dye-forming couplers are described in U.S. Pat. Nos. 3,451,820 and 4,080,211. Also, specific exampies of the polymerized magenta couplers are described in British Pat. No. 2,102,173 and U.S. Pat. No. 4,367,282.

The couplers for use in this invention can be used for one light-sensitive emulsion layer as a mixture of two or more for meeting the properties required for the color photographic material or the same kind of coupler may be incorporated to two or more photographic layers.

The couplers for use in this invention can be introduced into silver halide emulsions by an oil dropin-water dispersion method. That is, the coupler is dissolved in a high boiling organic solvent having boiling point of at least 175° C. or a low boiling so-called auxiliary solvent, or a mixture of both types of solvents, and then finely dispersed a water or an aqueous medium such as an aqueous gelatin solution in the presence of a surface active agent. Examples of the high boiling organic solvent are described in U.S. Pat. No. 2,322,027, etc. In this case, the coupler may be dispersed with phase inversion and also, if necessary, the auxiliary solvent may be removed by distillation, noodle washing, or ultrafiltration before coating the dispersion.

Specific examples of the high boiling organic solvent are phthalic acid esters (e.g., dibutyl phthalate, dicyclohexyl phthalate, di-2-ethylhexyl phthalate, decyl phthalate, etc.), phosphoric acid esters or phosphonic acid esters (e.g., triphenyl phosphate, tricresyl phosphate, 2-ethylhexyldiphenyl phosphate, tricyclohexyl phosphate, tri-2-ethylhexyl phosphate, tridecyl phosphate, tributoxyethyl phosphate, trichloropropyl phosphate, di-2-ethylhexylphenyl phosphonate, etc.), benzoic acid esters (e.g., 2-ethylhexyl benzoate, dodecyl benzoate, 2-ethylhexyl-p-hydroxy benzoate, etc.), amides (e.g., diethyldodecanamide, N-tetradecylpyrrolidone, etc.), alcohols or phenols (e.g., isostearyl alcohol, 2,4-di-tert-amylphenol, etc.), aliphatic carboxylic acid esters (e.g., dioctyl azelate, glycerol tributyrate, isostearyl lactate, trioctyl citrate, etc.), aniline derivatives (e.g., N,N-dibutyl-2-butoxy-5-tert-octylaniline, etc.), hydrocarbons (e.g., paraffin, dodecylbenzene, diisopropylnaphthalene, etc.), etc.

As the auxiliary solvent, organic solvents having boiling point of at least about 30° C., preferably from about 50° C. to about 160° C. can be used, and specific examples thereof are ethyl acetate, butyl acetate, ethyl propionate, methyl ethyl ketone, cyclohexanone, 2-ethoxyethyl acetate, dimethylformamide, etc.

A latex dispersing method can also be applied for incorporating the coupler into silver halide emulsions. The process and effect of the latex dispersing method and specific examples of the latex for impregnation are described in U.S. Pat. No. 4,199,363, West German Patent Application (OLS) Nos. 2,541,274, 2,541,230, etc.

A standard amount of the color coupler is in the range of from O.OO1 mol to 1 mol per mol of the light-sensitive silver halide in the silver halide emulsion layer, with from 0.01 mol to 0.5 mol of a yellow coupler, from 0.003 mol to 0.3 mol of a magenta coupler, and from 0.002 mol to 0.3 mol of a cyan coupler, per mol of the light-sensitive silver halide being preferred.

The color photographic materials for use in this invention may further contain hydroquinone derivatives, aminophenol derivatives, amines, gallic acid derivatives, catechol derivatives, ascorbic acid derivatives, non-coloring couplers, sulfonamidophenol derivatives, etc., as color fog preventing agents or color mixing preventing agent.

Also, the color photographic materials for use in this invention can further contain fading preventing agents. Typical examples of organic fading preventing agents are hydroquinones, 6-hydroxychromans, 5-hydroxycoumarans, spirochromans, p-alkoxyphenols, bisphenols, hindered phenols, gallic acid derivatives, methylenedioxybenzenes, aminophenols, hindered amines and the ether or ester derivatives of the aforesaid compounds obtained by silylating or alkylating the phenolic hydroxy group of these compounds. Also, metal complexes such as (bissalicylaldoxymate) nickel complex salt and (bis-N,N-dialkyldithiocarbamate) nickel complex salt can also be used as the fading preventing agent.

For preventing the deterioration of yellow dye images by heat, moisture, and light, the compound having both moieties of hindered amine and hindered phenol in one molecule as described in U.S. Pat. No. 4,268,593 gives good results. Also, for preventing the deterioration of magenta dye images, particularly by light, spiroindans described in Japanese Patent Application (OPI) No. 159644/81 and chromans substituted by hydroquinone diether or hydroquinone monoether described in Japanese Patent Application (OPI) No. 89835/80 give preferred results.

For improving the stability or storability, in particular, the light fastness of cyan dye images, it is preferred to use a benzotriazole series ultraviolet absorbent with the cyan coupler(s). The ultraviolet absorbent may be co-emulsified with the cyan coupler(s). The amount of the ultraviolet absorbent is desirably sufficient for imparting light stability to cyan dye images, but since if the amount is too much, the unexposed portions (background portions) of the color photographic material are sometimes yellowed, the amount thereof is usually selected in the range of from $1\times10^{-4}$ mol/m$^2$ to $2\times10^{-3}$ mol/m$^2$, particularly from $5\times10^{-4}$ mol/m$^2$ to $1.5\times10^{-3}$ mol/m$^2$.

In the layer structure of an ordinary color photographic paper, the ultraviolet absorbent(s) are incorporated in one or both layers adjacent to both sides of a red-sensitive silver halide emulsion layer containing cyan coupler. When the ultraviolet absorbent(s) are incorporated in the interlayer between a green-sensitive emulsion layer and a red-sensitive emulsion layer, the ultraviolet absorbent(s) may be emulsified together with a color mixing preventing agent. When the ultraviolet absorbent(s) are incorporated in a protective layer, another protective layer may be formed on the protective layer as the outermost layer. The outermost protective layer may contain a matting agent having a proper particle size.

The color photographic materials may further contain water-soluble dyes in the hydrophilic colloid layers as filter dyes or for the purpose of irradiation prevention or halation prevention.

As such water-soluble dyes, oxonol series dyes, anthraquinone series dyes, and azo series dyes are preferred. Oxonol dyes showing absorptions for green light and red light are particularly preferred.

The color photographic materials for use in this invention may further contain whitening agents such as stilbene series, triazine series, oxazole series, or coumarin series whitening agents in the photographic emulsion layers or other hydrophilic colloid layers. The whitening agent may be water-soluble or a water-insoluble whitening agent may be used as the form of the dispersion.

The process of this invention can be applied to a multilayer multicolor photographic material having at least two photographic emulsion layers each having different spectral sensitivity on a support. A multi-layer natural color photographic material usually has at least one red-sensitive emulsion layer, at least one green-sensitive emulsion layer, and at least one blue-sensitive emulsion layer on a support. The disposition order of the emulsion layers can be optionally selected according to the purposes. Also, each of the aforesaid emulsion layers may be composed of two or more emulsion layers each having different light sensitivity or a light-insensitive layer may exist between two or more emulsion layers each having the same sensitivity.

The color photographic material for use in this invention preferably has auxiliary layers such as protective layer(s), interlayers, a filter layer, an antihalation layer, a back layer, etc., in addition to the silver halide emulsion layers.

As a binder or protective colloid which can be used for the emulsion layers and auxiliary layers of the color photographic material for use in this invention, gelatin is advantageously used but other hydrophilic colloids can be used.

Examples of the protective colloid are proteins such as gelatin derivatives, graft polymers of qelatin and other polymers, albumin, casein, etc.; cellulose derivatives such as hydroxyethyl cellulose, carboxymethyl cellulose, cellulose sulfuric acid ester, etc.; saccharose derivatives such as sodium alginate, starch derivatives, etc.; and synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

The use of acrylic acid-modified polyvinyl alcohol is useful for protective layer and further is particularly useful in the case of quick processing color photographic material using high silver chloride containing silver halide emulsions.

As gelatin, limed gelatin as well as acidtreated gelatin and enzyme-treated gelatin as described in *Bull. Soc. Sci. Phot. Japan,* No. 16, p. 30 (1966) can be used. Furthermore, the hydrolyzed product or enzyme-decomposed product of gelatin can be used.

The color photographic materials for use in this invention may further contain various stabilizers, stain preventing agents, developing agents or the precursors therefor, development accelerators described hereinbefore or the precursors therefor, lubricants, mordants, matting agents, antistatic agents, plasticizers, or other photographically useful additives in addition to the above-described additives. Typical examples of such additives are described in *Research Disclosure,* RD No. 17643 (December, 1978) and ibid., RD No. 18716 (November, 1979).

The "reflective support" for the color photographic material which is processed in this invention is a support having high reflectivity for clearly viewing color images forming in silver halide emulsion layer(s) and includes a support coated with a hydrophobic resin having dispersed therein a light reflective material such as titanium oxide, zinc oxide, calcium carbonate, calcium sulfate , etc., and a support composed of a hydrophobic resin containing the light reflective material as described above as a dispersion thereof. Examples include baryta-coated papers, polyethylene-coated papers, polypropylene series synthetic papers, and transparent supports coated with a reflective layer or containing a reflective material as described above. Examples of such a transparent support are glass plates, polyester films (e.g., polyethylene terephthalate films, cellulose triacetate films, cellulose nitrate films, etc.), polyamide films, polycarbonate films, polystyrene films, etc. These supports can be properly selected according to the purposes thereof.

The following examples are intended to illustrate this invention more practically but not to limit it in any way.

EXAMPLE 1

A multilayer color photographic paper having layers of the compositions shown below on a paper support both surfaces of which were coated with polyethylene was prepared. In addition, the polyethylene coating on the emulsion-carrying side of the support contained titanium dioxide as a white pigment and ultramarine blue as a bluish dye. The coating compositions for the layers were prepared as follows.

Coating Composition for Layer 1

In 27.2 ml of ethyl acetate and 7.9 g of solvent (c) were dissolved 19.1 g of yellow coupler (a) and 4.4 g of color image stabilizer (b), and the solution was dispersed by emulsification in 185 ml of an aqueous 10% gelatin solution containing 8 ml of an aqueous solution of 10% sodium dodecylbenzenesulfonate. On the other hand, 90 g of a blue-sensitive silver halide emulsion was prepared by adding the blue sensitizing dye shown below to a silver chlorobromide emulsion (containing 80 mol % silver bromide and 70 g/kg of silver) in an amount of $7.0\times10^{-4}$ mol per mol of silver chlorobromide. The aforesaid emulsified dispersion of coupler was mixed with the aforesaid silver halide emulsion and the concentration of gelatin was controlled as shown below to provide the coating composition for Layer 1.

Coating compositions for Layers 2 to 7 were also prepared according to the method described above.

In addition, for each layer, 1-oxy-3,5-dichloros-triazine sodium salt was used as a gelatin hardening agent.

Also, spectral sensitizers used for the silver halide emulsions were as follows.

For the Blue-Sensitive Emulsion Layer

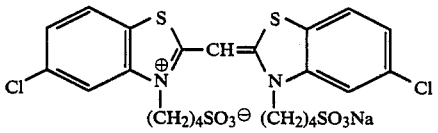

-continued ($7.0\times10^{-4}$ mol per mol of the silver halide)

For the Green-Sensitive Emulsion Layer

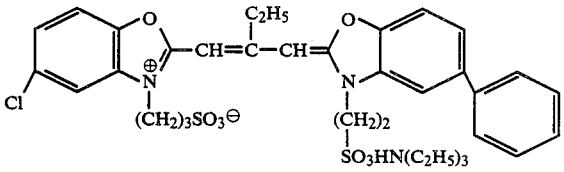

($4.0\times10^{-4}$ mol per mol of the silver halide)

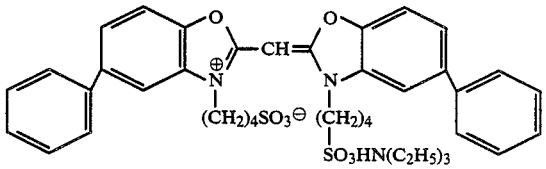

($7.0\times10^{-5}$ mol per mol of the silver halide)

For the Red-Sensitive Emulsion Layer

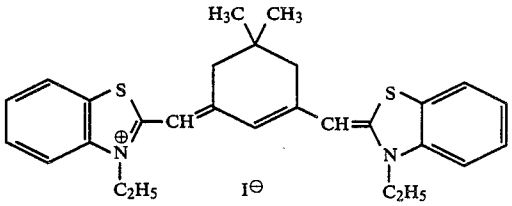

($1.0\times10^{-4}$ mol per mol of the silver halide)

Also, for the green-sensitive emulsion layer and the red-sensitive emulsion layer, the following dyes were used as irradiation preventing dyes.

For the Green-Sensitive Emulsion Layer

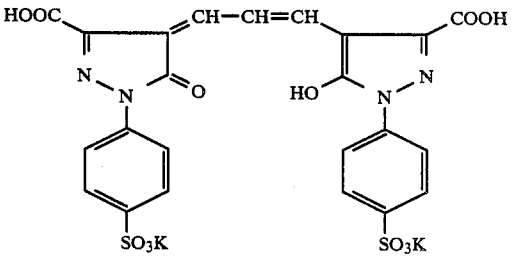

For the Red-Sensitive Emulsion Layer

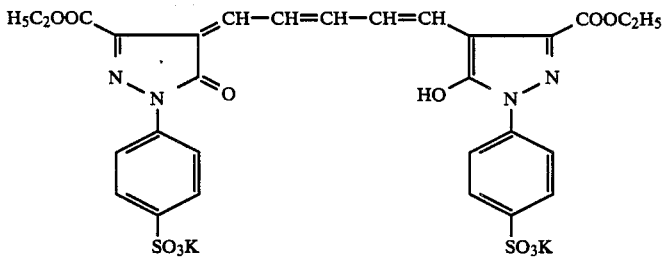

| | |
|---|---|
| Layer 1: Blue-Sensitive Emulsion Layer | |
| Silver chlorobromide emulsion | 0.30 g/m$^2$ (as silver) |
| (silver bromide: 80 mol %) | |
| Gelatin | 1.86 g/m$^2$ |
| Yellow coupler (a) | 0.82 g/m$^2$ |
| Color image stabilizer (b) | 0.19 g/m$^2$ |
| Solvent (c) | 0.34 ml/m$^2$ |
| Layer 2: Color Mixing Prevention Layer | |
| Gelatin | 0.99 g/m$^2$ |
| Color mixing preventing agent (d) | 0.08 g/m$^2$ |
| Layer 3: Green-Sensitive Emulsion Layer | |
| Silver chlorobromide emulsion | 0.16 g/m$^2$ (as silver) |
| (silver bromide: 75 mol %) | |
| Gelatin | 1.80 g/m$^2$ |
| Magenta coupler (e) | 0.34 g/m$^2$ |
| Color image stabilizer (f) | 0.20 g/m$^2$ |
| Solvent (g) | 0.68 ml/m$^2$ |
| Layer 4: Ultraviolet Absorbing Layer | |
| Gelatin | 1.60 g/m$^2$ |
| Ultraviolet absorbent (h) | 0.62 g/m$^2$ |

-continued

| | |
|---|---|
| Color mixing preventing agent (i) | 0.05 g/m$^2$ |
| Solvent (j) | 0.26 ml/m$^2$ |
| Layer 5: Red-Sensitive Emulsion Layer | |
| Silver chlorobromide emulsion | 0.26 g/m$^2$ (as silver) |
| (silver bromide: 70 mol %) | |
| Gelatin | 0.98 g/m$^2$ |
| Cyan coupler (k) | 0.38 g/m$^2$ |
| Color image stabilizer (l) | 0.17 g/m$^2$ |
| Solvent (m) | 0.23 ml/m$^2$ |
| Layer 6: Ultraviolet Absorbing Layer | |
| Gelatin | 0.54 g/m$^2$ |
| Ultraviolet absorbent (h) | 0.21 g/m$^2$ |
| Solvent (j) | 0.09 ml/m$^2$ |
| Layer 7: Protective Layer | |
| Gelatin | 1.33 g/m$^2$ |
| Acryl-modified copolymer of polyvinyl alcohol (modification degree: 17%) | 0.17 g/m$^2$ |

The compounds used for the above described layers are illustrated below by structural formulae.

Yellow Coupler (a)

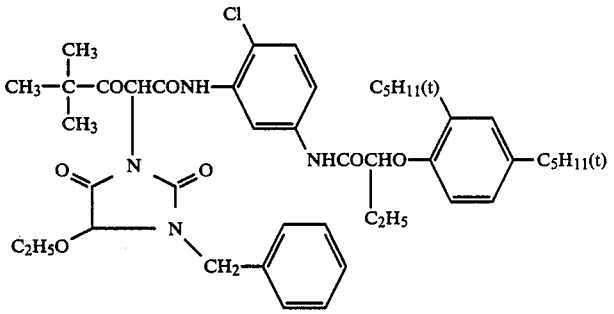

Color Image Stabilizer (b)

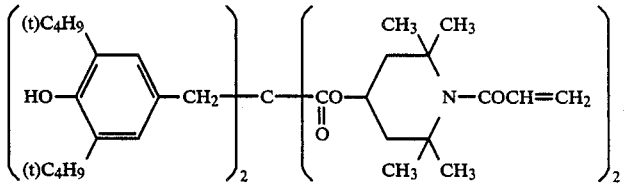

Solvent (c)

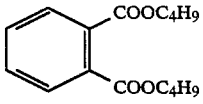

Color Mixing Preventing Agent (d)

-continued
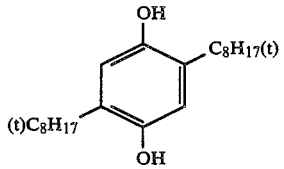
Magenta Coupler (e)
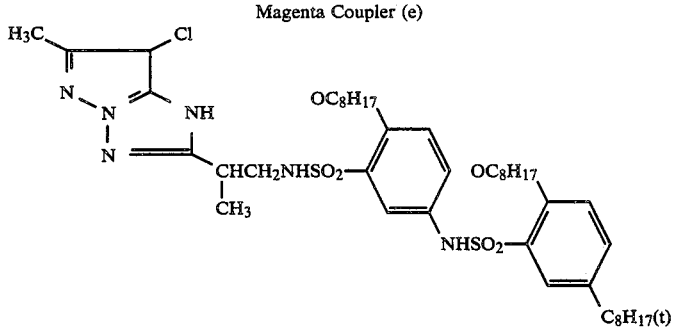
Color Image Stabilizer (f)
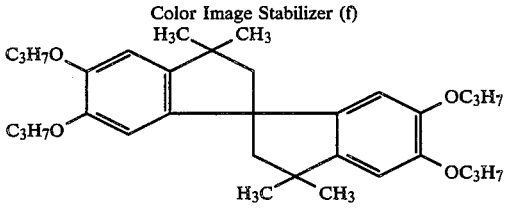
Solvent (g)
A 2/1 mixture (by weight ratio) of $(C_8H_{17}O)_3P{=}O$ and
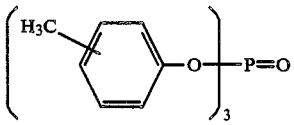
Ultraviolet Absorbent (h)
A mixture of the following (A), (B) and (C) of 1/5/3 by mol ratio.
(A)
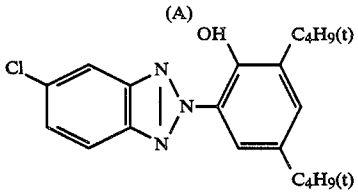
(B)
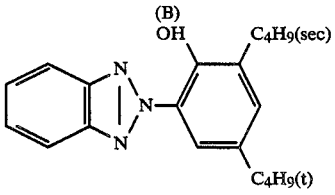
(C)
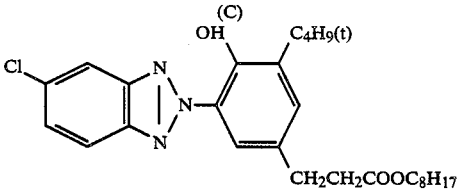
-continued
Color Mixing Preventing Agent (i)
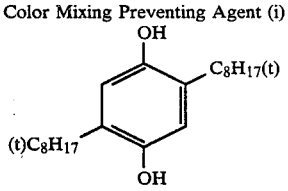
Solvent (j)
$(iso\text{-}C_9H_{18}O)_3P{=}O$
Cyan Coupler (k)
A 1/1 mixture (mol ratio) of the following couplers.
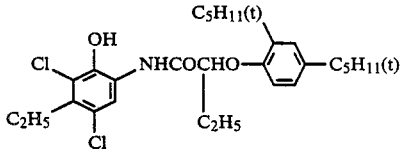
and -continued

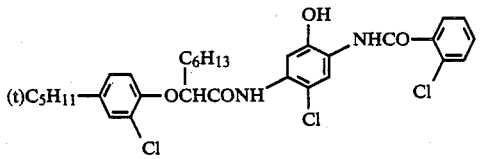

Color Image Stabilizer (l)

A 1/3/3 mixture (mol ratio) of the following stabilizers.

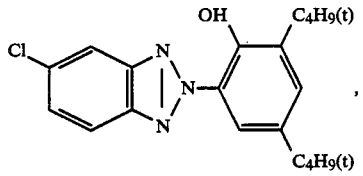

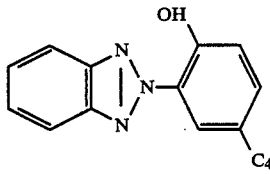

and

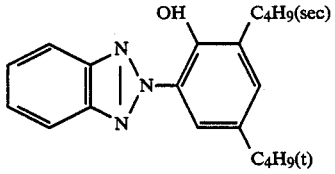

Solvent (m)

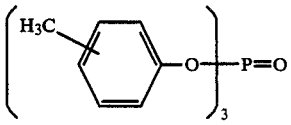

The multilayer color photographic paper having the above-described construction was imagewise exposed and continuously processed in the following Processing Step A or B until the amount of the replenisher for the color developer reached thrice the volume of the color developer tank (20 liters).

| Processing Step A: | | |
|---|---|---|
| Color development | 33° C. | 3 min 30 sec |
| Blix | 33° C. | 1 min 30 sec |
| Wash (1) | 24 to 30° C. | 1 min |
| Wash (2) | " | 1 min |
| Wash (3) | " | 1 min |
| Drying | 80° C. | 1 min |

-continued

| Processing Step B: | | |
|---|---|---|
| Color development | 36° C. | 45 sec |
| Blix | 36° C. | 45 sec |
| Wash (1) | 24 to 30° C. | 30 sec |
| Wash (2) | " | 30 sec |
| Wash (3) | " | 30 sec |
| Drying | 80° C. | 1 min |

As the wash step in the aforesaid Processing Steps, a countercurrent washing system from Wash (3) to Wash (1) was employed.

The compositions of the color developer and the blix liquid used for the above-described Processing Steps A and B were as follows:

| Color Developer: | | |
|---|---|---|
| Composition | Tank Liquid | Replenisher |
| Water | 800 ml | 800 ml |
| Diethylenetriaminepentaacetic acid | 3.0 g | 3.0 g |
| Benzyl alcohol | Shown in Table 1 | |
| Diethylene glycol | Shown in Table 1 | |
| Sodium sulfite | 2.0 g | 2.3 g |
| Potassium bromide | 1.0 g | — |
| Potassium carbonate | 30.0 g | 30.0 g |
| Compound for use in the invention (shown in Table 1) | Shown in Table 1 | |
| N—Ethyl-N—(β-methanesulfonamidoethyl)-3-methyl-4-aminoaniline sulfate | 5.5 g | 7.5 g |
| Hydroxylamine sulfate | 3.0 g | 3.5 g |
| Optical whitening agent (stilbene series) | 1.0 g | 1.0 g |
| Water to make | 1 l | 1 l |
| pH adjusted by KOH | 10.20 | 10.30 |

| Blix Liquid: | | |
|---|---|---|
| Composition | Tank Liquid | Replenisher |
| Water | 400 ml | 400 ml |
| Ammonium thiosulfate (70%) | 150 ml | 300 ml |
| Sodium sulfite | 18 g | 36 g |
| Ethylenediaminetetraacetic acid iron(III) ammonium | 55 g | 110 g |
| Ethylenediaminetetraacetic acid | 5 g | 10 g |
| Water to make | 1 l | 1 l |
| pH | 6.75 | 6.30 |

The amounts of the replenishers for the color developer, the blix liquid, and the wash water in this case were 160 ml, 100ml, and 10 l, respectively, per square meter of the color photographic material. The amount of the blix liquid carried to the wash bath was 40 ml per square meter of the color photographic material.

In processing with Processing Step A or B described above, the changes of yellow and magenta stain densities of the unexposed portions of the aforesaid color photographic paper from the initiation of the processing to the finish thereof were measured. THe changed amount of each stain after the end of the continuous processing to the initiation of the processing is shown in Table 1.

TABLE 1

| Test No. | Processing Step | Benzyl Alcohol (ml/l) Tank Liquid/ Replenisher | Diethylene Glycol (ml/l) Tank Liquid/ Replenisher | Compound No. (g/l) Tank Liquid/ Replenisher | Change of Stains after Processing Yellow | Magenta |
|---|---|---|---|---|---|---|
| 1 | A | 15/19 | 10/10 | None | +0.02 | +0.01 |
| 2 | B | 15/19 | 10/10 | None | +0.15 | +0.10 |
| 3 | B | 15/19 | 10/10 | I-(1) | +0.13 | +0.09 |

TABLE 1-continued

| Test No. | Processing Step | Benzyl Alcohol (ml/l) Tank Liquid/ Replenisher | Diethylene Glycol (ml/l) Tank Liquid/ Replenisher | Compound No. (g/l) Tank Liquid/ Replenisher | Change of Stains after Processing Yellow | Magenta |
|---|---|---|---|---|---|---|
| 4 | B | 15/19 | 10/10 | 1.0/1.1 I-(3) 1.0/1.1 | +0.12 | +0.08 |
| 5 | B | 15/19 | 10/10 | I-(5) 1.0/1.1 | +0.13 | +0.08 |
| 6 | B | None | None | None | +0.09 | +0.05 |
| 7* | B | None | None | I-(1) 1.0/1.1 | +0.02 | ±0 |
| 8* | B | None | None | I-(3) 1.0/1.1 | +0.02 | ±0 |
| 9* | B | None | None | I-(5) 1.0/1.1 | +0.02 | +0.01 |

*Invention

As is clear from the results shown in Table 1 above, it can be seen that by shortening the processing time for the color development to Processing Step A (Test No. 1), the formation of stains with respect to yellow and magenta after processing becomes severe (Test No. 2) and the extent of the stain formation may be improved to some extent by the addition of the compound for use in this invention (Test Nos. 3 to 5) but is yet inferior to the result of Test No. 1.

Also, it can be seen that Test No. 6 in Processing Step B using no benzyl alcohol shows improved formation of stain as compared to Test No. 2 in Processing B containing benzyl alcohol but the formation of stain can be greatly reduced by the compounds for use in this invention for the color photographic materials (Test Nos. 7 to 9).

EXAMPLE 2

The same procedure as in Example 1 was followed except that the amount of the replenisher for the wash water was changed to 250 ml per square meter of the color photographic material and water containing 0.5 g/liter of ethylenediaminetetraacetic acid disodium salt was used as the replenisher. The results obtained are shown in Table 2 below.

TABLE 2

| Test No. | Processing Step | Benzyl Alcohol (ml/l) Tank Liquid/ Replenisher | Diethylene Glycol (ml/l) Tank Liquid/ Replenisher | Compound No. (g/l) Tank Liquid/ Replenisher | Change of Stains after Processing Yellow | Magenta |
|---|---|---|---|---|---|---|
| 10 | A | 15/19 | 10/10 | None | +0.03 | +0.02 |
| 11 | B | 15/19 | 10/10 | None | +0.19 | +0.12 |
| 12 | B | 15/19 | 10/10 | I-(1) 1.0/1.1 | +0.14 | +0.09 |
| 13 | B | 15/19 | 10/10 | I-(3) 1.0/1.1 | +0.15 | +0.09 |
| 14 | B | 15/19 | 10/10 | I-(5) 1.0/1.1 | +0.15 | +0.09 |
| 15 | B | None | None | None | +0.15 | +0.09 |
| 16* | B | None | None | I-(1) 1.0/1.1 | +0.01 | +0.01 |
| 17* | B | None | None | I-(3) 1.0/1.1 | +0.01 | ±0 |
| 18* | B | None | None | I-(5) 1.0/1.1 | +0.01 | +0.01 |

*Invention

As is clear from the results shown in Table 2, it can be seen that by shortening the processing time for the color development in Processing Step A (Test No. 10), the stain formation of yellow and magenta after processing becomes severe (Test No. 11) and the stain formation extent may be improved to some extent by the addition of the compound for use in this invention (Test Nos. 12 to 14) but is inferior to Test No. 10.

Also, it can be seen that Test No. 15 in Processing Step B using no benzyl alcohol shows improved formation of stain as compared with Test No. 11 in Processing Step B using benzyl alcohol, but the formation of stain can be greatly reduced by the addition of the compounds for use in this invention (Test Nos. 16 to 18).

EXAMPLE 3

By following the same procedure as in Examples 1 and 2 about Compound I-(1) described above using the following five kinds of Replenishers A to E for wash step in place of the wash replenisher in Example 2, the change of stain was measured. The results show that only in the case of processing by the color developer containing the compound for use in this invention and containing no benzyl alcohol is the formation of stain greatly reduced even in quick processing.

The compositions of the replenishers for wash step were as follows.

| | |
|---|---|
| Wash Replenisher A: | |
| Sulfanylamide | 0.2 g/l |
| Wash Replenisher B: | |
| Benzotriazole | 0.5 g/l |
| Wash Replenisher C: | |
| Ethylenediamine-N,N,N',N'—tetramethylene-sulfonic acid | 0.5 g/l |
| pH adjusted to 7.0 with potassium hydroxide | |

-continued

| | |
|---|---|
| Wash Replenisher D: | |
| 1-Hydroxyethylidene-1,1-diphosphonic acid | 1.6 ml |
| Bismuth chloride | 0.35 g |
| Polyvinylpyrrolidone | 0.25 g |
| Aqueous ammonia (26%) | 2.5 ml |
| Nitrilotriacetic acid.3Na | 1.0 g |
| 5-Chloro-2-methyl-4-isothiazolin-3-one | 50 ml |
| 2-Octyl-4-isothiazolin-3-one | 50 ml |
| Optical whitening agent (4,4'-diamino-stilbene series) | 1.0 g |
| Water to make | 1 l |
| pH adjusted to 7.5 with potassium hydroxide | |
| Wash Replenisher E: | |
| 1-Hydroxyethylidene-1,1-diphosphonic acid (60%) | 2.0 ml |
| Ammonium alum | 0.5 g |
| Sulfanylamide | 100 mg |
| Aqueous ammonia (26%) | 1.8 ml |
| Water to make | 1 l |
| pH adjusted to 7.5 with potassium hydroxide | |

-continued

EXAMPLE 4

A color photographic paper was prepared by following the same procedure as the case of preparing the color photographic paper in Example 1, except the following points.

That is, the following compounds were used as spectral sensitizers for the emulsion layers of the color photographic material.

For the Blue-Sensitive Emulsion Layer:

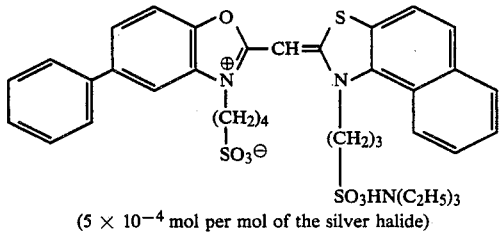

($5 \times 10^{-4}$ mol per mol of the silver halide)

For the Green-Sensitive Emulsion Layer:

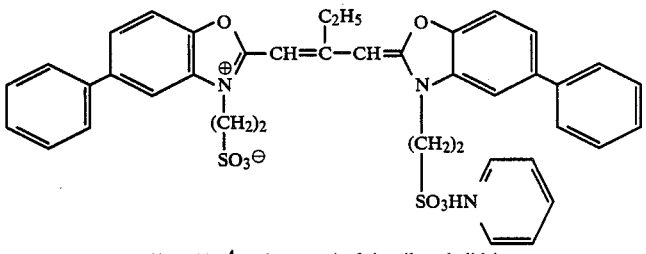

($4 \times 10^{-4}$ mol per mol of the silver halide)

For the Red-Sensitive Emulsion Layer:

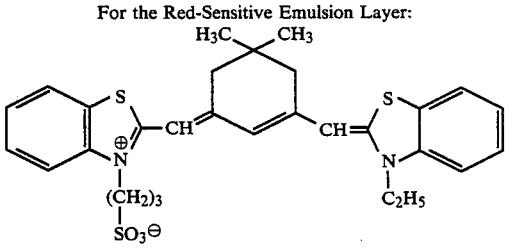

($2 \times 10^{-4}$ mol per mol of the silver halide)

The contents of silver bromide in the silver chlorobromide emulsions used in Layers 1, 3 and 5 were 1 mol %, 0.5 mol %, and 1 mol %, respectively.

Also, the following couplers were used in place of yellow coupler (a) and magenta coupler (e) in example 1.

Yellow Coupler

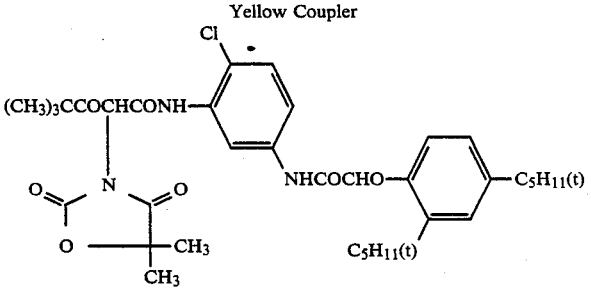

(coated amount: 0.82 g/m$^2$)

-continued

Magenta Coupler

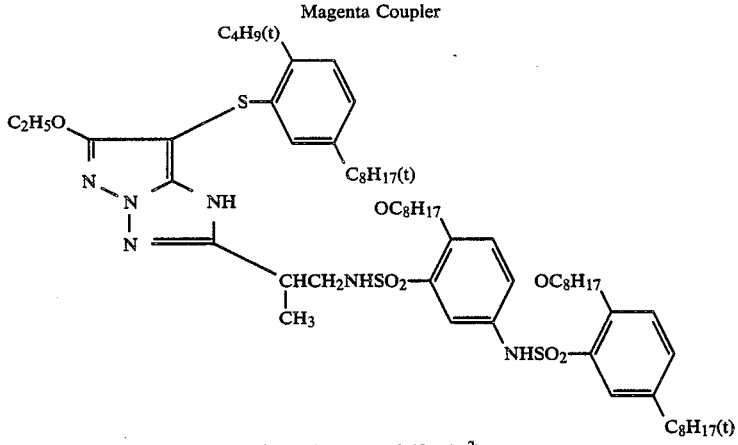

(coated amount: 0.48 g/m$^2$)

The color photographic paper described above was continuously processed in the following processing step, wherein the composition of the color developer was changed as shown in Table 3 below, until the amount of the replenisher for the color developer became thrice the volume of the tank for the color developer.

| Processing Step | Temperature (°C.) | Time (sec) | Tank Volume (l) |
|---|---|---|---|
| Color development | 35 | 45 | 10 |
| Blix | 35 | 45 | 10 |
| Rinse 1 | 35 | 20 | 4 |
| Rinse 2 | 35 | 20 | 4 |
| Rinse 3 | 35 | 20 | 4 |
| Drying | 80 | 60 | |

For the rinse in the aforesaid processing step, a countercurrent wash system from Rinse 3 to Rinse 1 was employed. The compositions of the processing liquids were as follows.

Color Developer:

| Composition | Tank Liquid | Replenisher |
|---|---|---|
| Hydroxylamine | Shown in Table 3 | |
| Benzyl alcohol | Shown in Table 3 | |
| Diethylene glycol | Shown in Table 3 | |
| Compound of formula (I) | Shown in Table 3 | |
| Triethanolamine | 10 ml | 10 ml |
| Sodium sulfite | 0.2 g | 0.2 g |
| Potassium sulfite | 25 g | 25 g |
| Ethylenediaminetetraacetic acid.2Na | 1 g | 1 g |
| Sodium chloride | 1.5 g | — |
| 4-Amino-3-methyl-N—ethyl-N—[β-(methanesulfonamido)ethyl]-p-phenylenediamine.sulfate | 5.0 g | 7.0 g |
| Optical whitening agent (4,4'-diaminostilbene series) | 3.0 g | 4.5 g |
| Water to make | 1 l | 1 l |
| pH | 10.05 | 10.45 |

-continued

Blix Liquid: (tank liquid and the replenisher had the same composition)

| | |
|---|---|
| Ethylenediaminetetraacetic acid iron(III) ammonium.2$H_2O$ | 60 g |
| Ethylenediaminetetraacetic acid 2Na.2$H_2O$ | 4 g |
| Ammonium thiosulfate (70%) | 120 ml |
| Sodium sulfite | 16 g |
| Glacial acetic acid | 7 g |
| Water to make | 1 l |
| pH | 5.5 |

Rinse Liquid: (tank liquid and the replenisher had the same composition)

| | |
|---|---|
| 1-Hydroxyethylidene-1,1-diphosphonic acid (60%) | 1.6 ml |
| Aqueous ammonia (26%) | 2.5 ml |
| Nitrilotriacetic acid.3Na | 1.0 g |
| Ethylenediaminetetraacetic acid.4H | 0.5 g |
| Sodium sulfite | 1.0 g |
| 5-Chloro-2-methyl-4-isothiazolin-3-one | 50 mg |
| Water to make | 1 l |
| pH | 7.0 |

In addition, the amount of replenisher per square meter of the color photographic paper was 150 ml for the color developer, 150 ml for the blix liquid, and 200 ml for the rinse liquid. The amount of the blix liquid carried to the rinse bath was 40 ml per square meter of the color photographic material.

The changes of yellow, magenta and cyan stains between the beginning of the processing and the end of the processing were measured as in Example 1 and the results obtained are shown in Table 3 below.

TABLE 3

| Test No. | Benzyl Alcohol (ml/l) Tank Liquid/ Replenisher | Diethylene Glycol (ml/l) Tank Liquid/ Replenisher | Hydroxylamine Tank Liquid: 5 × $10^{-2}$ M Replenisher 7.5 × $10^{-2}$ M | Compound No. Tank Liquid: 1 × $10^{-3}$ M Replenisher: 1 × $10^{-3}$ M | Change of Stains Yellow | Magenta | Cyan |
|---|---|---|---|---|---|---|---|
| 19 | 10/15 | 10/10 | II-(33) | I-(3) | +0.14 | +0.07 | +0.04 |
| 20 | 10/15 | 10/10 | II- (5) | I-(11) | +0.13 | +0.06 | +0.02 |
| 21 | None | None | II-(33) | None | +0.09 | +0.04 | +0.02 |
| 22* | None | None | II-(34) | I-(11) | +0.03 | +0.02 | 0 |
| 23* | None | None | II-(33) | I-(11) | +0.02 | +0.02 | 0 |
| 24* | None | None | II- (5) | I-(11) | 0 | 0 | 0 |

TABLE 3-continued

| Test No. | Benzyl Alcohol (ml/l) Tank Liquid/ Replenisher | Diethylene Glycol (ml/l) Tank Liquid/ Replenisher | Hydroxylamine Tank Liquid: $5 \times 10^{-2}$ M Replenisher $7.5 \times 10^{-2}$ M | Compound No. Tank Liquid: $1 \times 10^{-3}$ M Replenisher: $1 \times 10^{-3}$ M | Change of Stains Yellow | Magenta | Cyan |
|---|---|---|---|---|---|---|---|
| 25* | None | None | II- (5) | I- (3) | 0 | 0 | 0 |

*Invention

As is clear from the results shown in Table 3, the increase of stain in quick processing is greatly reduced according to the process of this invention and, in particular, the use of alkylhydroxylamine (Test Nos. 23 to 25) is preferred and further the case of using the substituted alkylhydroxylamine is more preferred (Test Nos. 24 and 25).

EXAMPLE 5

In Test No. 25 in Example 4, hydroxylamines II-(1), II-(2), II-(3), II-(12), II-(20), II-(29) and II-(32) were used in place of II-(5). It was confirmed that the increase of stains was inhibited and good results were obtained as in Test No. 25 of Example 4.

EXAMPLE 6

A color photographic paper was prepared by coating Layer 1 (the lowermost layer) to Layer 7 (the uppermost layer) shown below on a paper support, both surfaces of which were coated with polyethylene, subjected to a corona discharging treatment.

In this case, the coating composition for Layer 1 was prepared as follows. That is, to 200 g of the yellow coupler shown below, 93.3 g of the fading preventing agent shown below, 10 g of high boiling solvent (p), and 5 g of high boiling solvent (g) was added 600 ml of ethyl acetate as an auxiliary solvent and after heating the mixture to 60° C. to dissolve the additives, the mixtures was mixed with 3,300 ml of an aqueous 5% gelatin solution containing 330 ml of a 5% aqueous solution of Alkanol B (alkylnaphthalenesulfonate, trademark for product made by E. I. du Pont de Nemours and Company) followed by emulsification using a colloid mill to provide a coupler dispersion. From the dispersion was distilled off ethyl acetate under reduced pressure, the residue was added to 1,400 g of a silver halide emulsion (containing 96.7 g of silver and 170 g of gelatin) containing the sensitizing dye for blue-sensitive emulsion layer described below and 1-methyl-2-mercapto-5-acetylamino-1,3,4-triazole, and further 2,600 g of an aqueous 10% gelatin solution was added to the mixture to provide the coating composition.

The coating compositions for Layer 2 to Layer 7 were also prepared by similar manner to the aforesaid method.

| | |
|---|---|
| Layer 1: Blue-Sensitive Emulsion Layer | |
| Silver chlorobromide emulsion | 290 mg/m$^2$ |
| (silver bromide: 1 mol %) | (as silver) |
| Yellow coupler | 600 mg/m$^2$ |
| Fading preventing agent (r) | 280 mg/m$^2$ |
| Solvent (p) | 30 mg/m$^2$ |
| Solvent (q) | 15 mg/m$^2$ |
| Gelatin | 1,800 mg/m$^2$ |
| Layer 2: Color Mixing Preventing Layer | |
| Silver bromide emulsion (primitive | 10 mg/m$^2$ |
| grain size: 0.05 μm) | (as silver) |
| Color mixing preventing agent (s) | 55 mg/m$^2$ |
| Solvent (p) | 30 mg/m$^2$ |
| Solvent (q) | 15 mg/m$^2$ |
| Gelatin | 800 mg/m$^2$ |

-continued

| | |
|---|---|
| Layer 3: Green-Sensitive Emulsion Layer | |
| Silver chlorobromide emulsion | 305 mg/m$^2$ |
| (silver bromide: 0.5 mol %) | (as silver) |
| Magenta coupler | 670 mg/m$^2$ |
| Fading preventing agent (t) | 150 mg/m$^2$ |
| Fading preventing agent (u) | 10 mg/m$^2$ |
| Solvent (p) | 200 mg/m$^2$ |
| Solvent (q) | 10 mg/m$^2$ |
| Gelatin | 1,400 mg/m$^2$ |
| Layer 4: Color Mixing Preventing Layer | |
| Color mixing preventing agent (s) | 65 mg/m$^2$ |
| Ultraviolet absorbent (n) | 450 mg/m$^2$ |
| Ultraviolet Absorbent (o) | 230 mg/m$^2$ |
| Solvent (p) | 50 mg/m$^2$ |
| Solvent (q) | 50 mg/m$^2$ |
| Gelatin | 1,700 mg/m$^2$ |
| Layer 5: Red-Sensitive Emulsion Layer | |
| Silver chlorobromide emulsion | 210 mg/m$^2$ |
| (silver bromide: 1 mol %) | (as silver) |
| Cyan coupler (C-2) | 260 mg/m$^2$ |
| Cyan coupler (C-1) | 120 mg/m$^2$ |
| Fading preventing agent (r) | 250 mg/m$^2$ |
| Solvent (p) | 160 mg/m$^2$ |
| Solvent (q) | 100 mg/m$^2$ |
| Gelatin | 1,800 mg/m$^2$ |
| Layer 6: Ultraviolet Absorbing Layer | |
| Ultraviolet absorbent (n) | 260 mg/m$^2$ |
| Ultraviolet absorbent (o) | 70 mg/m$^2$ |
| Solvent (p) | 300 mg/m$^2$ |
| Solvent (q) | 100 mg/m$^2$ |
| Gelatin | 700 mg/m$^2$ |
| Layer 7: Protective Layer | |
| Gelatin | 600 mg/m$^2$ |

The following spectral sensitizers were used for the aforesaid emulsion layers.

For the Blue-Sensitive Emulsion Layer

Anhydro-5-methoxy-5'-methyl-3,3'-disulfopropylselenacyanine hydroxide

For the Green-Sensitive Emulsion Layer

Anhydro-9-ethyl-5,5'-diphenyl-3,3'-disulfoethyloxacarbocyanine hydroxide

For the Red-Sensitive Emulsion Layer 3,3'-Diethyl-5-methoxy-9,9'-(2,2-dimethyl-1,3-propano)tridicarbocyanine iodide Also, the following compound was used for each emulsion layer as a stabilizer:

1-Methyl-2-mercapto-5-acetylamino-1,3,4-triazole

Furthermore, the following compounds were used for each emulsion layer as irradiation prevention dyes:

4-[3-Carboxy-5-hydroxy-4-{3-[3-carboxy-5-oxo-1-(4-sulfonaphthophenyl)-2-pyrazolin-4-iridene]-1-propenyl}-1-pyrazolyl]benzenesulfonate dipotassium salt N,N'-(4,8-Dihydroxy-9,10-dioxo-3,7-disulfonatoanthraquinone-1,5-diyl)bis(aminomethanesulfonate) tetrasodium salt Also, for each layer described above, 1,2-bis(vinylsulfonyl)ethane was used as a hardening agent.

Moreover, the compounds used for the layers of the color photographic paper described above were as follows:

Ultraviolet Absorbent (n)

2-(2-Hydroxy-3,5-di-tert-amylphenyl)benzotriazole

Ultraviolet Absorbent (o)

2-(2-Hydroxy-3,5-di-tert-butylphenyl)benzotriazole

Solvent (p)

Di(2-ethylhexyl) phthalate

Solvent (q)

Dibutyl phthalate

Fading Prevent Agent (r)

2,5-Di-tert-amylphenyl-3,5-di-tert-butylhydroxybenzoate

Color Mxing Preventing Agent (s)

2,5-Di-tert-octylhydroquinone

Fading Prevent Agent (t)

1,4-Di-tert-amyl-2,5-dioctyloxybenzene

Fading Preventing Agent (u)

2,2'-Methylenebis(4-methyl-6-tert-butylphenol)

Yellow Coupler

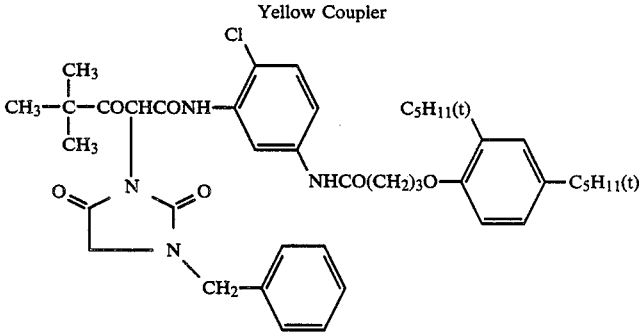

Magenta Coupler

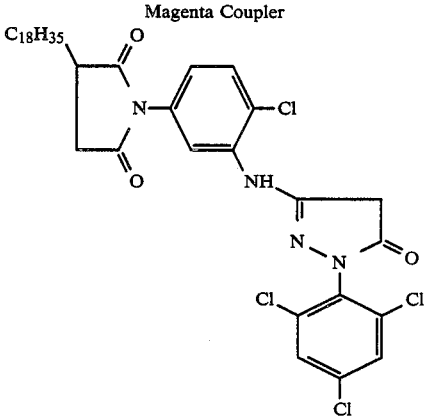

C-1

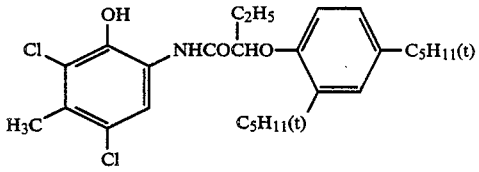

C-2

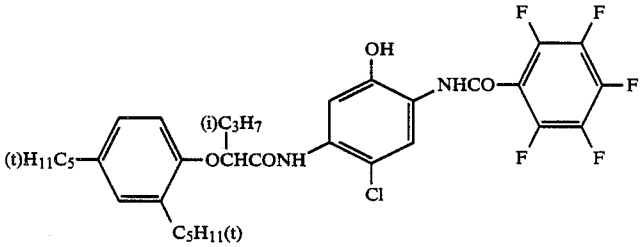

The color photographic paper thus obtained was continuously processed as in Example 4 and the change of stains was measured. The results show that the process of this invention gives good results without the increase of stain as in Example 4.

In this Example, however, the stabilizing liquid having the following composition was used instead of the rinse liquid in Example 4.

| Stabilizing Liquid: (tank liquid and the replenisher had the same composition) | |
|---|---|
| 5-Chloro-2-methyl-4-isothiazoyl-3-one | 40 mg |
| 5-Methyl-4-isothiazolin-3-one | 10 mg |
| 2-Octyl-4-isothiazolin-3-one | 10 mg |
| Bismuth chloride (40%) | 0.5 g |
| Nitrilo-N,N,N—trimethylenephosphonic acid (40%) | 1.0 g |
| 1-Hydroxyethylidene-1,1-diphosphonic acid (60%) | 2.5 g |
| Optical whitening agent (4,4'-diamino-stilbene series) | 1.0 g |
| Aqueous ammonia (26%) | 2.0 ml |
| Water to make | 1 l |
| pH adjusted to 7.5 with potassium hydroxide | |

EXAMPLE 7

By following the same procedure as in Example 4 while changing the rinse step to a wash step of replenishing water in an amount of 10 liters/m$^2$, it was confirmed that according to the process of this invention, the formation of stains is reduced and good photographic performance can be obtained.

While the invention has been described in detail and with reference to specific embodiments thereof, it will be apparent to one skilled in the art that various changes and modifications can be made therein without departing from the spirit and scope thereof.

What is claimed is:

1. A process for processing a silver halide color photographic material, which comprises processing a silver halide color photographic material having at least one silver halide emulsion layer on a reflective support with a color developer containing not more than 0.5 ml/l of benzyl alcohol and containing a compound represented by formula (I)

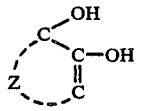

(I)

wherein Z represents an atomic group forming an aromatic nucleus, wherein said processing comprises blixing and thereafter washing or stabilizing or washing and stabilizing with aldehyde compoundfree washing water or stabilizing liquid wherein the washing water or stabilizing liquid is replenished, and the amount of replenisher for the washing water or stabilizing liquid in the washing and/or stabilizing step is from 0.1 to 50 times the amount of liquid carried into the washing and/or stabilizing step from a bath prior to the washing and/or stabilizing step per unit area of the color photographic material.

2. A process for processing a silver halide color photographic material as in claim 1, wherein the color developer contains an aromatic primary amine color developing agent.

3. A process for processing a silver halide color photographic material as in claim 2, wherein the color developer contains a hydroxylamine represented by formula (II)

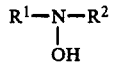

(II)

wherein $R^1$ and $R^2$ each represents a hydrogen atom, a substituted or unsubstituted alkyl group, a substituted or unsubstituted alkenyl group, or a substituted or unsubstituted aryl group, or $R^1$ and $R^2$ together form a heterocyclic ring with the nitrogen atom.

4. A process for processing a silver halide color photographic material as in claim 1, wherein the blixing time is 1 minute or less and the total processing time for washing and stabilization is 2 minutes or less.

5. A process for processing a silver halide color photographic material, which comprises processing a silver halide color photographic material having at least one red-sensitive emulsion layer, at least one green-sensitive emulsion layer, and at least one blue-sensitive emulsion layer on a reflective support with a color developer, a blix liquid, and then wash water, a stabilizing liquid, or wash water and a stabilizing liquid, said color developer containing not more than 0.5 mol/l benzyl alcohol and containing an aromatic primary amine color developing agent and a compound represented by formula (I)

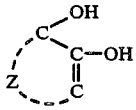

(I)

wherein Z represents an atomic group forming an aromatic nucleus wherein said wash water and said stabilizing liquid are free of an aldehyde compound and wherein the wash water or the stabilizing liquid are replenished and wherein the amount of replenisher of the wash water or the stabilizing liquid is from 0.1 to 50 times the amount of liquid carried into the wash water or the stabilizing liquid from a prebath per unit area of the color photographic material.

6. A process for processing a silver halide color photographic material as in claim 5, wherein the color developer further contains a hydroxylamine represented by formula (II)

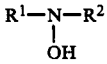

(II)

wherein $R^1$ and $R^2$ each represents a hydrogen atom, a substituted or unsubstituted alkyl group, a substituted or unsubstituted alkenyl group, or a substituted or unsubstituted aryl group, or $R^1$ and $R^2$ together form a heterocyclic ring with the nitrogen atom.

7. A process for processing a silver halide color photographic material as in claim 5, wherein the blixing time is 1 minute or less and the total processing time for the washing and stabilization is 2 minutes or less.

8. A process for processing a silver halide color photographic material as in claim 1, wherein the compound represented by formula (I) has one to three substituents selected from the group consisting of a sulfo group, a carboxy group, and a hydrogen atom.

9. A process for processing a silver halide color photographic material as in claim 1, wherein the substituent is a sulfo group.

10. A process for processing a silver halide color photographic material as in claim 1, wherein the compound represented by formula (I) is present in an amount of from 0.00005 to 0.1 mol per liter of the color developer.

11. A process for processing a silver halide color photographic material as in claim 3, wherein the hydroxylamine is present in an amount of from 0.1 to 20 g per liter of the color developer.

12. A process for processing a silver halide color photographic material as in claim 3, wherein a substituent for the alkyl group, the alkenyl group and the aryl group represented by $R^1$ and $R^2$ is selected from the group consisting of a hydroxy group, an alkoxy group, a sulfonyl group, an amido group, a carboxy group, a cyano group, a sulfo group, a nitro group, and an amino group.

13. A process for processing a silver halide color photographic material as in claim 1, wherein a silver halide of the emulsion layer contains substantially no silver iodide and is selected from silver bromide, silver chlorobromide, and silver chloride.

14. A process for processing a silver halide color photographic material as in claim 1, wherein the silver halide color photographic material contains a 2.5-diacylamino-substituted phenolic cyan coupler.

15. A process for processing a silver halide color photographic material as in claim 1, wherein the silver halide color photographic material contains a pyrazoloazaole series magenta coupler.

* * * * *